US010340132B2

(12) United States Patent
Baba

(10) Patent No.: US 10,340,132 B2
(45) Date of Patent: Jul. 2, 2019

(54) OPTIMIZED ELECTROMAGNETIC FIELD ON SIDE-ON FT-ICR MASS SPECTROMETERS

(71) Applicant: DH Technologies Development Pte. Ltd., Singapore (SG)

(72) Inventor: Takashi Baba, Richmond (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 15/773,720

(22) PCT Filed: Nov. 24, 2016

(86) PCT No.: PCT/IB2016/057082

§ 371 (c)(1),
(2) Date: May 4, 2018

(87) PCT Pub. No.: WO2017/093860

PCT Pub. Date: Jun. 8, 2017

(65) Prior Publication Data

US 2018/0323052 A1 Nov. 8, 2018

Related U.S. Application Data

(60) Provisional application No. 62/260,967, filed on Nov. 30, 2015.

(51) Int. Cl.
*H01J 49/38* (2006.01)
*H01J 49/42* (2006.01)

(52) U.S. Cl.
CPC ..... *H01J 49/4255* (2013.01); *H01J 49/38* (2013.01); *H01J 49/424* (2013.01)

(58) Field of Classification Search
None
See application file for complete search history.

(56) References Cited

U.S. PATENT DOCUMENTS 4,931,640 A 6/1990 Marshall et al.
9,960,026 B1 * 5/2018 Hughes ..... H01J 41/14
(Continued)

OTHER PUBLICATIONS

International Search Report and Written Opinion for PCT/IB2016/057082 dated Feb. 24, 2017.

*Primary Examiner* — Andrew Smyth
(74) *Attorney, Agent, or Firm* — John R. Kasha; Kelly L. Kasha; Kasha Law LLC

(57) ABSTRACT

Improvements to a side-on Penning trap include a feedback system for stabilizing the magnetic field. This system includes a magnetic sensor that measures the magnetic field and a solenoid coil that in response to the magnetic field measurements increases or decreases the overall magnetic field. Improvements also include a number of different configurations of the two sets of PCB electrodes used to produce the quadrupole electric field. Dimensions of the PCB electrodes are optimized, an equipotential surface electrode is added, and additional ring electrodes are added to produce a purer quadrupole field. A central disk electrode is segmented to direct charged particles to the trap center to make the trap useful for applications other than mass spectrometry. Finally, outer ring electrodes are segmented to increase the path of charged particles, thereby increasing sensitivity.

11 Claims, 26 Drawing Sheets

(56) References Cited

U.S. PATENT DOCUMENTS

| | | | | |
|---|---|---|---|---|
| 2002/0008198 | A1 | 1/2002 | Kasten et al. | |
| 2008/0078930 | A1 | 4/2008 | Baba et al. | |
| 2009/0218485 | A1 | 9/2009 | Kaiser et al. | |
| 2010/0072362 | A1* | 3/2010 | Giles | H01J 49/4295 250/287 |
| 2013/0270433 | A1 | 10/2013 | Ding et al. | |
| 2014/0299761 | A1* | 10/2014 | Giles | H01J 49/421 250/283 |

* cited by examiner

400

600

800

1200

1400

1700

OPTIMIZED ELECTROMAGNETIC FIELD ON SIDE-ON FT-ICR MASS SPECTROMETERS

CROSS REFERENCE TO RELATED APPLICATION

This application claims the benefit of U.S. Provisional Patent Application Ser. No. 62/260,967, filed Nov. 30, 2015, the content of which is incorporated by reference herein in its entirety.

INTRODUCTION

The teachings herein relate to magnetic ion traps, and more particularly, to methods and systems for improving the performance of a side-on injection Penning trap by stabilizing the magnetic and producing a substantially pure quadrupole field using various electrode configurations.

Mass spectrometry (MS) is an analytical technique that allows the determination of the mass-to-charge ratio (m/z) of ions of sample molecules. Generally, mass spectrometry involves ionizing sample molecule(s) and analyzing the ions in a mass analyzer. One exemplary MS technique known in the art is Fourier transform ion cyclotron resonance (FT-ICR) mass spectrometry. FT-ICR mass spectrometry has received considerable attention for its ability to make accurate, high resolution mass measurements.

FIG. 1 demonstrates the general structure of one FT-ICR mass spectrometer system 100 known in the art. FT-ICR mass spectrometer system 100 includes an ion source 110, a first mass analyzer 120, and an FT-ICR unit 140. In operation, the first mass analyzer 120 (e.g., linear quadrupole electrodes 122 to which RF and/or DC voltages can be applied) receives ions from the ion source 110 and filters those ions (e.g., selectively transmits ions of a selected m/z range) to the downstream elements to be further analyzed.

In known systems, the FT-ICR unit 140 generally comprises a magnetic ion trap (e.g., a Penning trap) having a ring electrode 142 and two end-cap electrodes 144*a,b*. A Penning trap is a device used to store charged particles. A Penning trap generally stores charged particles using a homogeneous magnetic field and an inhomogeneous quadrupole electric field. The end-cap electrodes 144*a,b* include orifices 146 disposed on the central, longitudinal axis (A) of the MS system 100 through which ions are received from the ion source 110/first mass analyzer 140 and through which the ions are transmitted to downstream elements (e.g., mass analyzer 160), respectively. In order to trap the charged particles, FT-ICR units like that shown in FIG. 1 generally utilize a static electric field generated between the end-cap electrodes 144*a,b* (typically maintained at a DC voltage of the same polarity as the ions to be trapped) and the ring electrode 142 (typically maintained at a DC voltage of the opposite polarity as the ions to be trapped) to confine the ions axially (i.e., in the z-direction along the central axis (A) between the orifices 146 of the end-cap electrodes 144*a,b*). Additionally, a static, uniform magnetic field (B, typically not less than 1 T) is applied along the direction in which ions are injected (i.e., along the central axis (A)) so as to confine the charged particles radially (i.e., in the x- and y-directions, perpendicular to the axis of the magnetic field).

Because the resolution capability of FT-ICR is generally related to the uniformity and intensity of the magnetic field to which the ions are subjected (e.g., certain performance features vary as a function of the square of the intensity of the magnetic field such that a minimum value of about 1 T is recommended in high performance MS applications), magnetic ion traps for FT-ICR have traditionally utilized strong electromagnets or super-conducting electromagnets (e.g., solenoid 148, within which the ring electrode 142 and end-cap electrodes 144*a,b* are housed) to produce the high-intensity magnetic fields (e.g., at least 1 T, sometimes as high as 7-15 Tesla) along the central axis (A), as schematically depicted in FIG. 1 by the arrow indicating the direction of the magnetic field (B). Such electromagnets, however, can be extremely expensive and cumbersome (e.g., heavy, bulky), and require complex power supplies and/or cooling installations for operation. The high cost and limited mobility of FT-ICR systems resulting from the size of the magnets (electromagnets or permanent) has heretofore limited the adoption of FT-ICR despite the technique's potential benefits (e.g., high accuracy and resolution).

U.S. Provisional Application No. 62/085,459 (hereinafter the "'459 Application"), entitled "Fourier Transform Ion Cyclotron Resonance Mass Spectrometry, is directed to a new FT-ICR system or mass spectrometer. This new system uses a new side-on injection Penning trap. This trap uses smaller, less expensive permanent magnets (as well as electromagnets) to reduce the cost, size, and/or complexity of the trap relative to conventional Penning traps. This new side-on injection Penning trap enables Fourier transform ion cyclotron resonance mass spectrometry to be performed in a relatively narrow gap and allows ions to be injected into the trap in a direction substantially perpendicular to the magnetic fields applied to the gap. As a result, smaller, less expensive magnets can be used to produce the high-intensity, uniform magnetic fields utilized in high performance FT-ICR/MS applications.

FIG. 2 is an exemplary schematic diagram of a side-on injection FT-ICR system 200. Side-on injection FT-ICR system 200 includes an ion source 210 for generating ions from a sample of interest, an ion guide 220 for focusing and/or filtering the ions to be transmitted thereby, a side-on injection Penning trap 240, and a downstream mass analyzer 260 (as an option). The exemplary side-on injection Penning trap 240 includes a plurality of electrodes 242, 244 for generating an electric field within the side-on injection Penning trap 240 and at least one magnet 248 for generating a magnetic field between the electrodes 242, 244 such that the ions can be trapped via the combination of the effects thereon of the electric and magnetic fields.

In various aspects, ions generated by the ion source 210 can be injected into the side-on injection Penning trap 240 substantially along the central axis (A). After being transmitted into the side-on injection Penning trap 240 and into the space bounded by the electrodes 242, 244 disposed on opposed sides of the central axis (A), the ions are subjected to the magnetic and electric fields generated therein via the magnet(s) 248 and the electrodes 242, 244. As schematically depicted in FIG. 2, for example, the magnet(s) 248 can be configured to generate a magnetic field (B) within the side-on injection Penning trap 240 having a magnetic field axis that is substantially perpendicular to the injection axis/central axis (A).

The at least one magnet 248 can have a variety of configurations for generating a magnetic field within the side-on injection Penning trap 240. By way of non-limiting example, the at least one magnet 248 can be one or more permanent magnets (i.e., an object made from magnetized material that creates its own magnetic field) or an electromagnet (e.g., a solenoid that generates a magnetic field when an electric current flows therethrough) that are configured to generate a uniform, high-intensity magnetic field within the gap between the electrodes 242, 244 in a direction substantially perpendicular to the injection axis. The electrodes 242, 244 can also have a variety of configurations such that various electric potentials can be applied thereto so as to change the electric field within the side-on injection Penning trap 240, thereby altering the amplitude of ions' cyclotron motion and/or the trajectory of the ions' drift.

One of the most important features of FT-ICR mass spectrometers is their high mass resolution. Mass resolution is proportional to magnetic field strength. As a result, present conventional axial injection FT-ICR systems, like the system of FIG. 1, often use a super conducting magnet with a field strength of higher than 10 Tesla.

In contrast, the permanent magnet or small electromagnet of the side-on injection Penning trap of the FT-ICR system of FIG. 2 cannot produce as great a magnetic field strength. The present maximum field strength of a permanent magnet is 1.2~1.3 Tesla. In addition, if cone-shaped pure-iron pole pieces are used, the magnetic field strength can be amplified (or focused) up to 3.0 Tesla. Although side-on injection FT-ICR mass spectrometers have a lower magnetic field strength than conventional FT-ICR mass spectrometers, they can still provide a mass resolution greater than 20,000.

However, pure magnetic field strength of the magnets is not the only factor that determines mass resolution. The stability and uniformity of the magnetic field produced are also important. Maintaining the stability and uniformity of the magnetic field is a potential problem in a side-on injection FT-ICR mass spectrometer.

More specifically, the magnetic field strength of a side-on injection FT-ICR mass spectrometer is not only dependent on the grade of the magnet material and the size radius and thickness) of the magnet(s), but also on the gap distance between electrodes (or pole pieces) in which the field is applied. In order to increase magnetic field strength, stability, and uniformity, the gap distance should be small. However, to increase the amount of ions trapped, the gap should be wide. As a result, systems and methods are needed to provide the widest possible gap distance in a side-on Penning trap, while maintaining magnetic field strength, stability and uniformity.

Another factor found to affect the mass resolution in a side-on injection FT-ICR mass spectrometer is the quality of the electric or direct current (DC) field produced in the gap between electrodes. As is widely known, oscillation motion in Penning trap (or FT-ICR cell) is described as follows, $$\omega_z = \frac{\omega_c}{2} \pm \sqrt{\frac{\omega_z^2}{4} - \frac{\omega_c^2}{2}},$$

$$\omega_z^2 = \frac{qV}{\pi d^2}$$

$$\omega_c = \frac{qE}{\pi},$$

where the magnetic field is uniform, and the DC field is a pure quadrupole field. $\omega_c$ is the cyclotron frequency and $\omega_z$ is the oscillation frequency along the magnetic field.

In the case of a conventional axial injection FT-ICR using a strong super conducting magnet, $\omega_c$ is much larger than $\omega_z$, so the following approximated formulae are usually used.

$$\omega_+ = \omega_c,$$

$$\omega_- = \frac{\omega_c^2}{2\omega_z} = \frac{V}{\pi E d^2}.$$

The higher frequency (ω+) is the cyclotron frequency with good precision, and the lower frequency (ω−) is the magnetron motion frequency.

Because the cyclotron frequency is much bigger than the magnetron frequency and the contribution of V in the mass resolution is very small, the DC field for axial confinement does not have to be a pure quadrupole field, though a non-quadrupole field produces a frequency difference on the orbital size of ion motion. Because of this, a conventional axial injection FT-ICR spectrometer often uses a cylindrical FT-ICR cell instead of a pure quadrupole Penning trap.

Unfortunately, as described above, the magnetic field of a side-on injection FT-ICR mass spectrometer using permanent magnets is not as strong as the magnetic field of a conventional axial injection FT-ICR mass spectrometer, so the approximation may not be applicable. This means that with a side-on injection FT-ICR mass spectrometer, magnetron motion contamination in the higher frequency solution must be considered when analyzing the data. To avoid ion trajectory dependence, which makes mass resolution worse, the DC field of a side-on injection FT-ICR mass spectrometer should be a pure quadrupole field. As a result, systems and methods are also needed to make the "purest" possible quadrupole field between the two narrow printed circuit board (PCB) electrodes in a side-on injection Penning trap of an FT-ICR mass spectrometer.

Therefore, the mass resolution of a side-on injection FT-ICR mass spectrometer can be enhanced by both improving the stability and uniformity of the magnetic field and producing a purer quadrupole electric field. In addition to mass resolution, the sensitivity of an FT-ICR mass spectrometer is important. Sensitivity can be enhanced by increasing the total number of ions trapped in an FT-ICR.

FIG. 3 is an exemplary schematic diagram of an electrode 242 of the side-on injection FT-ICR system 200 of FIG. 2. An exemplary SIMION simulation is depicted in FIG. 3, demonstrating the path 310 of a cation during its injection from the ion guide 220 of FIG. 2 into the magnetic trap 240 of FIG. 2, during which the depicted exemplary potentials of FIG. 3 are applied to the electrodes 242*a-e* of FIG. 3 (SIMION is an ion motion simulator in vacuum provided by Scientific Instrument Service, Inc. NJ). The electrodes 242*a-e* are formed on a PCB, for example.

As indicated by arrow 320 of Figure, the cation is injected into the gap between the electrodes 242, 244 of FIG. 2 substantially along the central axis of the ion guide 220. Upon entering the side-on injection Penning trap 240 of FIG. 2, the ion is subject to the electric field generated by the electrodes 242, 244 of FIG. 2 and the uniform magnetic field generated in the gap between the electrodes. As demonstrated schematically and understood by a person skilled in the art, the cation would tend to move along an equipotential line of superimposed electrical potential gradient within the uniform magnetic field generated by the magnets 248 of FIG. 2, with the cation's cyclotron motion overlapping on the transverse motion (drift).

Accordingly, upon entering the side-on injection Penning trap 240 of FIG. 2, the cation proceeds initially along the non-conducting portion between the upper arch electrodes 242*d,b* of FIG. 3 (−1V) and the lower arch electrodes 242*e,c* of FIG. 3 (+1V). At the intersection of the upper, inner arch electrode 242*b* (−1V), the lower, inner arch electrode 242*c*

(+1V), and the center electrode 242*a* (−1V), however, the ion is deflected from its initial axis along equipotential lines around the center electrode 242*a* (−1V) and the lower, inner arch electrode 242*c* (+1V). As such, the cation travels substantially along the non-conductive portion between the center electrode 242*a* (−1V) and the lower, inner arch electrode 242*c* (+1V). At the intersection of the lower, inner arch electrode 242*c* (+1V), the center electrode 242*a* (−1V), and the upper, inner arch electrode 242*b* (−1V), the cation is again deflected along the non-conductive portion extending between the lower, inner arch electrode 242*c* (+1V) and the upper, inner arch electrode (−1V), and is ejected along the non-conductive portion on the left side of FIG. 3. As such, under the exemplary conditions depicted in FIG. 3, the cation can be transmitted through the magnetic ion trap (e.g., into downstream mass analyzer of FIG. 2), the ejection from the magnetic ion trap again occurring substantially along the central axis (A) of FIG. 2. It should be appreciated that the arrangement of the electrodes 242*a-e* and the potentials applied thereto in FIG. 3 are merely exemplary, and can be modified in order to otherwise control the motion of the ions. By way of example, if the polarity of the electrodes 242*a-e* of FIG. 3 were reversed, it would be appreciated that an anion injected into this modified trap would exhibit substantially the same path through the magnetic ion trap as that depicted for the cation in FIG. 3.

FIG. 3, however, shows that only a small portion, path 310, of the area of electrode 242 is used for trapping ions. As described above, sensitivity is directly related to the number of ions that are trapped. As a result, systems and methods are needed to increase the trapping area of a side-on injection Penning trap in order to improve the sensitivity of an FT-ICR system.

SUMMARY

Various embodiments include a system and method to stabilize the magnetic field in a side-on injection Penning trap. The system, for example, includes at least one solenoid coil, a current source, at least one magnetic sensor, and feedback control circuitry. The current source supplies electric current to the at least one solenoid coil to produce a second magnetic field that is applied to charged particles in the Penning trap. A first magnetic field is applied in the Penning trap by at least one permanent magnet. The at least one magnetic sensor measures a combined magnetic field in the mass spectrometer that is a combination of the first magnetic field and the second magnetic field. The feedback control circuitry receives over time the combined magnetic field measured by the at least one magnetic sensor. In response, the feedback control circuitry adjusts the current of the current source to increase or decrease the second magnetic field in order to maintain the combined magnetic field at a constant value. Improved magnetic field stability improves the mass resolution of FT-ICR mass spectrometry, for example.

Various embodiments include a side-on injection Penning trap that includes two sets of PCB electrodes with radial dimensions that are optimized to apply an improved quadrupole electric field to charged particles. In the side-on injection Penning trap the space between a first set of PCB electrodes and a second set of PCB electrodes is a cylindrical gap used to trap charged particles. The cylindrical gap has a length d. The first set of PCB electrodes and the second set of PCB electrodes each include a central disk electrode, a first concentric ring electrode, and a second concentric ring electrode. In order to optimize the quadrupole electric field applied to the cylindrical gap, in each set of PCB electrodes the radius of the central disk electrode is made to be 1.1 d, the radius of the first concentric ring electrode is made to be 1.9 d, and the radius of the second concentric ring electrode is made to be 2.4 d. An improved quadrupole electric field improves the mass resolution of FT-ICR mass spectrometry, for example.

Various embodiments include a side-on injection Penning trap that includes two sets of PCB electrodes and an equipotential surface electrode that is placed between the two sets of PCB electrodes to apply an improved quadrupole electric field to charged particles. The equipotential surface electrode is formed from two cones that intersect at their apexes. The equipotential surface electrode extends through the center of a cylindrical gap between the two sets of PCB electrodes and is coaxial with the cylindrical gap. An improved quadrupole electric field improves the mass resolution of FT-ICR mass spectrometry, for example.

Various embodiments include a side-on injection Penning trap that includes two sets of PCB electrodes that each includes four or more concentric circular or semi-circular electrodes to improve resolution. This trap can also be used to improve the mass resolution of FT-ICR mass spectrometry, for example.

Various embodiments include a side-on injection Penning trap that includes two sets of PCB electrodes that each includes a segmented central disk electrode to bring charged particles to the center of the trap. The space between the two sets of PCB electrodes is a cylindrical gap used to trap charged particles. The segments of the central disk electrodes of the two sets of PCB electrodes a path for the charged particles to move to the center of the cylindrical gap. Trapping ions in the center of the trap is useful for atomic physics including quantum computing experiments.

Various embodiments include a side-on injection Penning trap that includes two sets of PCB electrodes that each includes one or more outer ring electrodes. The outer ring electrodes are each segmented and biased to increase the pathway of charged particles around the trap to more than 180 degrees so that more ions can be placed in the trap, thereby increasing the sensitivity of measurements made with the trap.

BRIEF DESCRIPTION OF THE DRAWINGS

The skilled artisan will understand that the drawings, described below, are for illustration purposes only. The drawings are not intended to limit the scope of the present teachings in any way.

Figure 1:
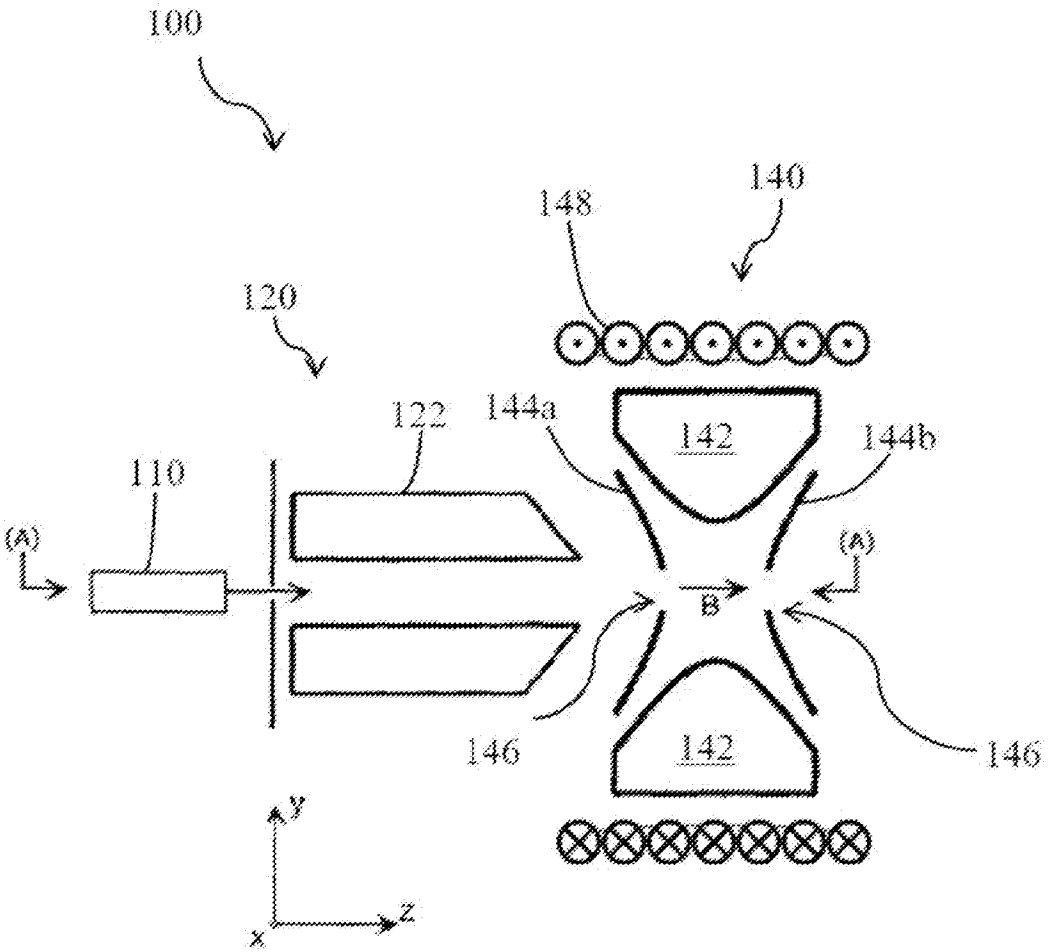
FIG. 1 (PRIOR ART)
FIG. 1 demonstrates the general structure of one FT-ICR mass spectrometer system known in the art.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

Figure 4:
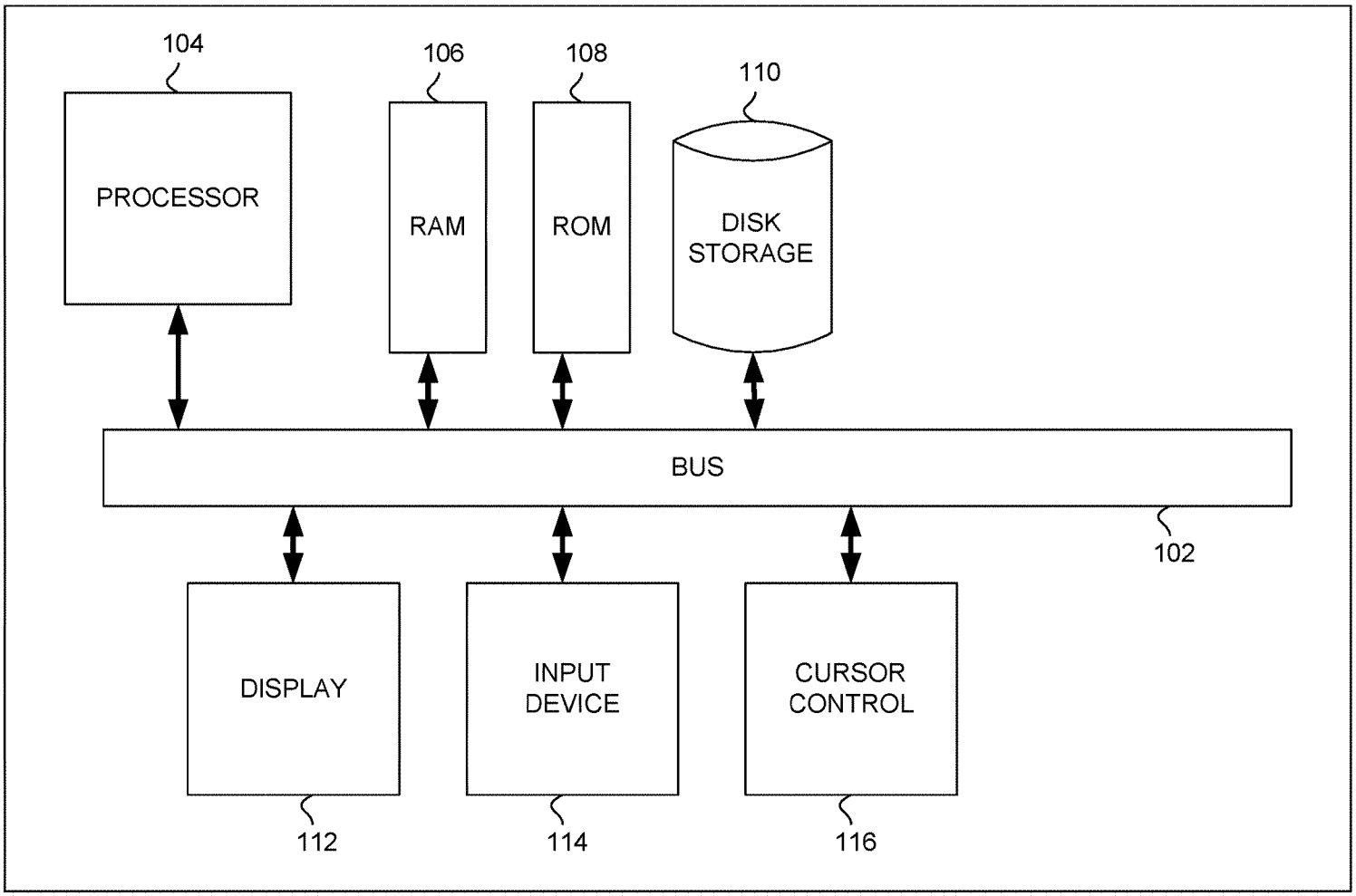
FIG. 4 is a block diagram that illustrates a computer system, upon which embodiments of the present teachings may be implemented.

FIG. 4 is a block diagram that illustrates a computer system 400, upon which embodiments of the present teachings may be implemented. Computer system 400 includes a bus 102 or other communication mechanism for communicating information, and a processor 104 coupled with bus 102 for processing information. Computer system 400 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 400 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 400 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

Computer system 400 can perform the present teachings. Consistent with certain implementations of the present teachings, results are provided by computer system 400 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

In various embodiments, computer system 400 can be connected to one or more other computer systems, like computer system 400, across a network to form a networked system. The network can include a private network or a public network such as the Internet. In the networked system, one or more computer systems can store and serve the data to other computer systems. The one or more computer systems that store and serve the data can be referred to as servers or the cloud, in a cloud computing scenario. The one or more computer systems can include one or more web servers, for example. The other computer systems that send and receive data to and from the servers or the cloud can be referred to as client or cloud devices, for example.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media or computer program products include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 400 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Side-on Injection Penning Trap Improvements

As described above, FIG. 2 depicts a side-on injection FT-ICR system as described by the '459 Application, which is incorporated herein by reference in its entirety. This new side-on injection FT-ICR system includes a new side-on Penning trap that uses smaller, less expensive permanent magnets (as well as electromagnets) and PCB electrodes to reduce the cost, size, and/or complexity of the system relative to conventional Penning traps. This side-on injection Penning trap enables Fourier transform ion cyclotron resonance mass spectrometry across relatively narrow gap magnetic fields substantially perpendicular to the axis along which the ions are injected into the ion trap.

One of the most important features of FT-ICR mass spectrometers is their high mass resolution. Side-on injection FT-ICR systems generally cannot provide mass resolutions as high as conventional FT-ICR systems, because their less expensive magnets cannot produce magnetic fields of similar strength.

This lower magnetic field strength coupled with the electrode gap configuration of side-on injection FT-ICR systems introduces two additional problems that further affect mass resolution. First, the lower magnetic field strength means that if the gap between electrodes is increased significantly, the mass resolution is further reduced, because the mass resolution is also dependent on the stability and uniformity of the magnetic field in the gap. As a result, systems and methods for improving the stability and uniformity of the magnetic field in the gap of side-on of a side-on Penning trap are needed.

Second, the lower magnetic field strength makes maintaining a high mass resolution dependent on producing an almost pure quadrupole electric field in the gap between electrodes. However, the gap cannot be made wide enough to include quadrupole electrodes. As a result, systems and methods for producing a pure quadrupole electric field in a gap of a side-on injection Penning trap using PCB electrodes are needed.

Figure 2:
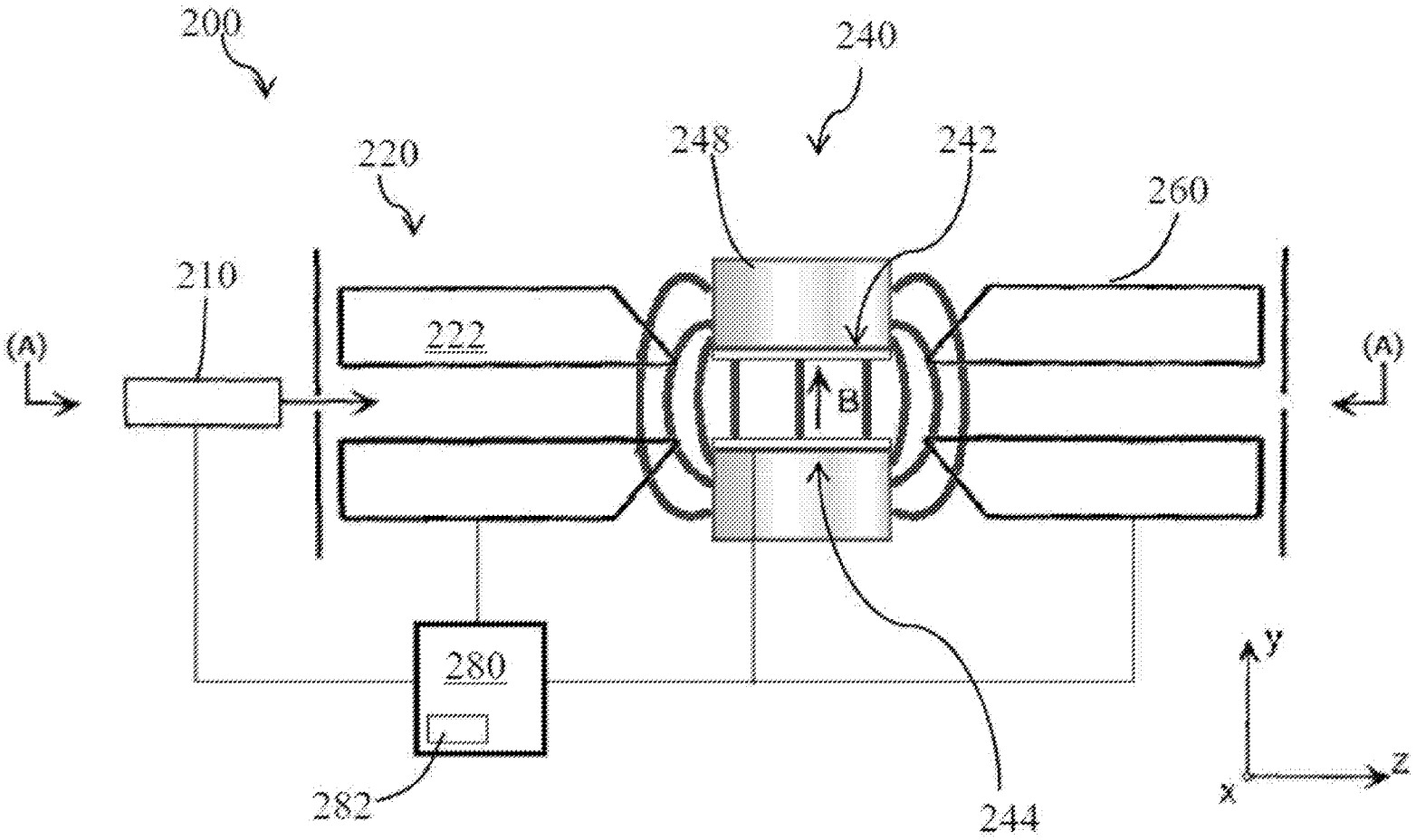
FIG. 2 (PRIOR ART)
FIG. 2 is an exemplary schematic diagram of a side-on injection FT-ICR system.
Figure 3:
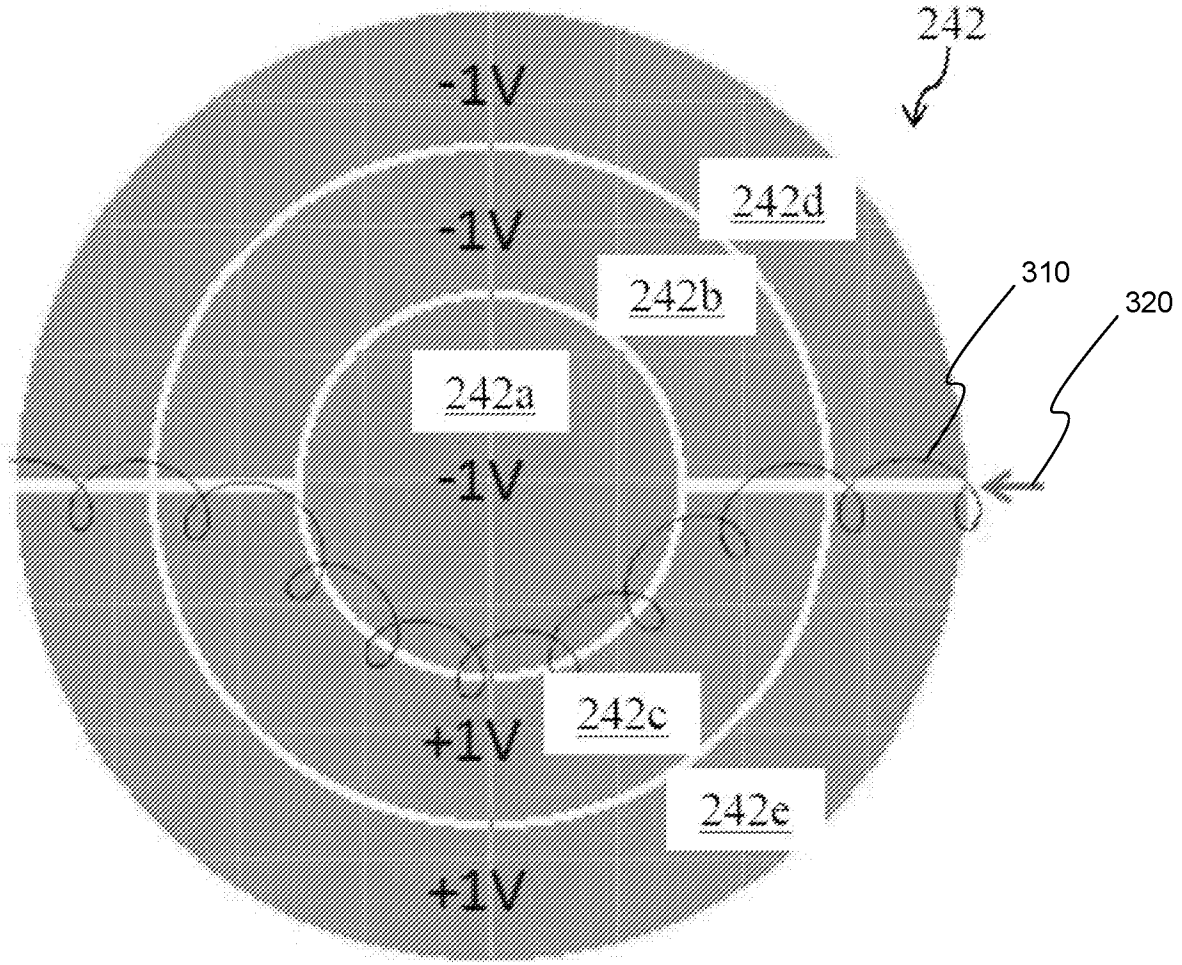
FIG. 3 (PRIOR ART)
FIG. 3 is an exemplary schematic diagram of an electrode of the side-on injection FT-ICR system of FIG. 2.

Maintaining a high sensitivity is also important in FT-ICR systems. As described above, sensitivity is directly related to the number of ions that are trapped in an FT-ICR system. As shown in FIG. 3, the side-on injection FT-ICR system of FIG. 2 only uses a small portion of the area of an electrode for trapping ions. As a result, systems and methods for utilizing the area of PCB electrodes of side-on injection Penning trap to increase the number of ions trapped are needed.

Improvement to Stability of the Magnetic Field

The stability of a magnetic field is determined, for example, by the change in magnetic field strength over time. The uniformity of a magnetic field is determined, for example, by the change in magnetic field strength over some distance. A small change in magnetic field strength has a greater effect on a magnetic field with a lower strength or intensity. For example, a change in magnetic field strength of ±0.1 Tesla is 1% of a magnetic field of 10 Tesla, while the same change in magnetic field strength of ±0.1 Tesla is 3.3% of a magnetic field of 3 Tesla.

As described above, magnetic field strength is directly proportional to mass resolution in FT-ICR systems. As a result, a change in magnetic field strength has a greater effect on the mass resolution of FT-ICR systems that have a smaller magnetic field strength, like side-on injection FT-ICR systems.

The stability or uniformity of the magnetic field in an FT-ICR system can be affected in many different ways. For example, the magnetic field can be affected by the changing of the earth's magnetic field, by operating a huge current device near the FT-ICR spectrometer (elevators, trains and street cars near the building), or by magnetic fields generated by vacuum pumps.

In various embodiments, the magnetic field of a side-on injection Penning trap is stabilized by using a magnetic field sensor to monitor the strength of the magnetic field applied in the gap between electrodes and by using a solenoid or solenoid coils to increase or decrease the magnetic field in response to the measurement from the magnetic field sensor. In other words, the variation of the magnetic field strength can be stabilized through feedback control by monitoring the field strength using a magnetic field sensor and slightly changing the magnetic field strength using a solenoid or electromagnet.

Figure 5:
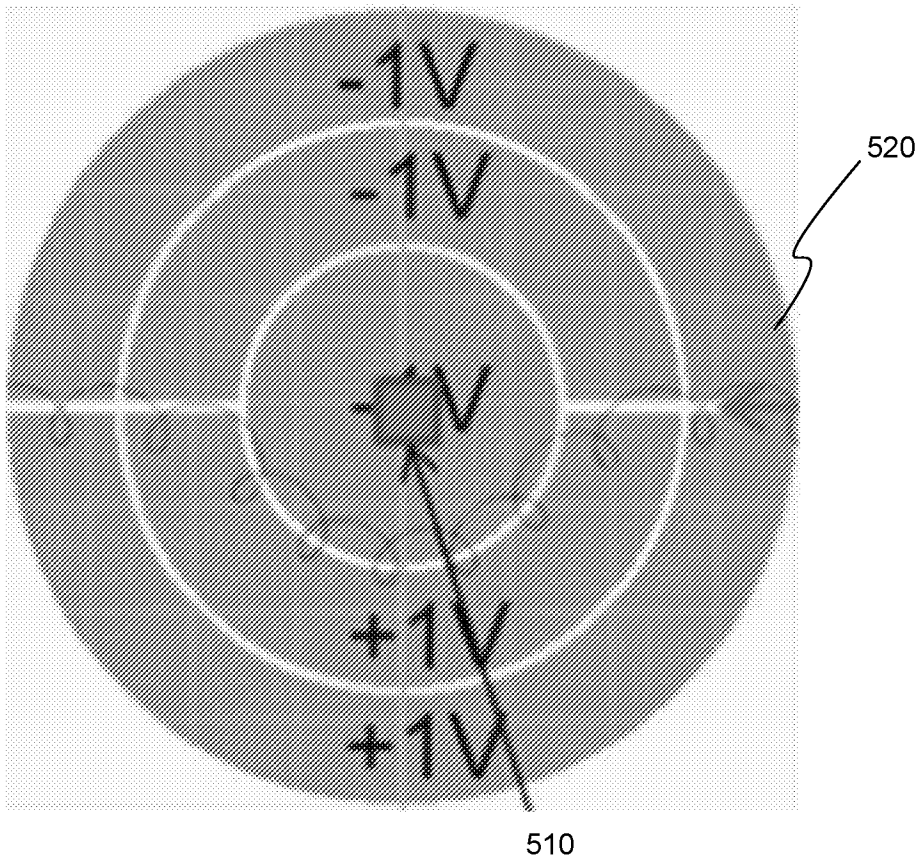
FIG. 5 is a schematic diagram of a printed circuit board (PCB) electrode of a side-on injection Penning trap showing a magnetic field sensor attached to the center of the PCB electrode, in accordance with various embodiments.

FIG. 5 is a schematic diagram 500 of a PCB electrode of a side-on injection Penning trap showing a magnetic field sensor attached to the center of the PCB electrode, in accordance with various embodiments. Magnetic field sensor 510 is attached to PCB electrode 520. Magnetic field sensor 510 is attached to the center of PCB electrode 520, but is not limited to placement in the center of PCB electrode 520. In various embodiments, magnetic field sensor 510 can be placed anywhere in, on, in front of, behind, or near PCB electrode 520. Magnetic field sensor 510 has a measurement capability of between 0 and 3 Tesla, for example.

FIG. 5 shows the placement of only one magnetic field sensor. In various embodiments, two or more magnetic field sensors can be placed in, on, in front of, behind, or near PCB electrode 520. Placing magnetic field sensors across PCB electrode 520 can provide information on the uniformity of the magnetic field in addition to the stability of the magnetic field, for example.

FIG. 5 shows only one PCB electrode. In various embodiments one or more magnetic field sensors can be placed on a second PCB electrode (not shown).

Figure 6:
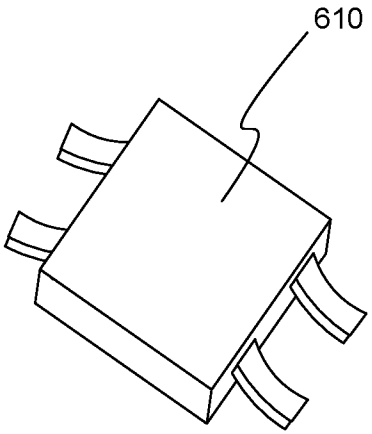
FIG. 6 is a schematic diagram of a Hall effect magnetic field sensor that can be placed on a PCB electrode, in accordance with various embodiments.

FIG. 6 is a schematic diagram 600 of a Hall effect magnetic field sensor that can be placed on a PCB electrode, in accordance with various embodiments. Hall effect magnetic field sensor 610 or Hall element 610 is shown in a surface mount package for mounting on a PCB. Hall element 610 is one non-limiting example of magnetic field sensor 510 shown in FIG. 5. Hall element 610, for example, measures a voltage that is proportional to the magnetic field it senses.

In response to the measurements taken or recorded by a magnetic field sensor, the stability of the magnetic field of a Penning trap is stabilized by increasing or decreasing the magnetic field. The magnetic field is increased or decreased using one or more solenoids or one or more electromagnets. A solenoid is, for example, a coil tightly wound in concentric loops about an axis. An electromagnet is, for example, a coil tightly wound in concentric loops about a cylinder of ferromagnetic material. Both solenoids and electromagnets can produce a magnetic field along their axes by applying a current to their coils. In both devices, the direction of the current determines the direction of the magnetic field along the axis.

Figure 7:
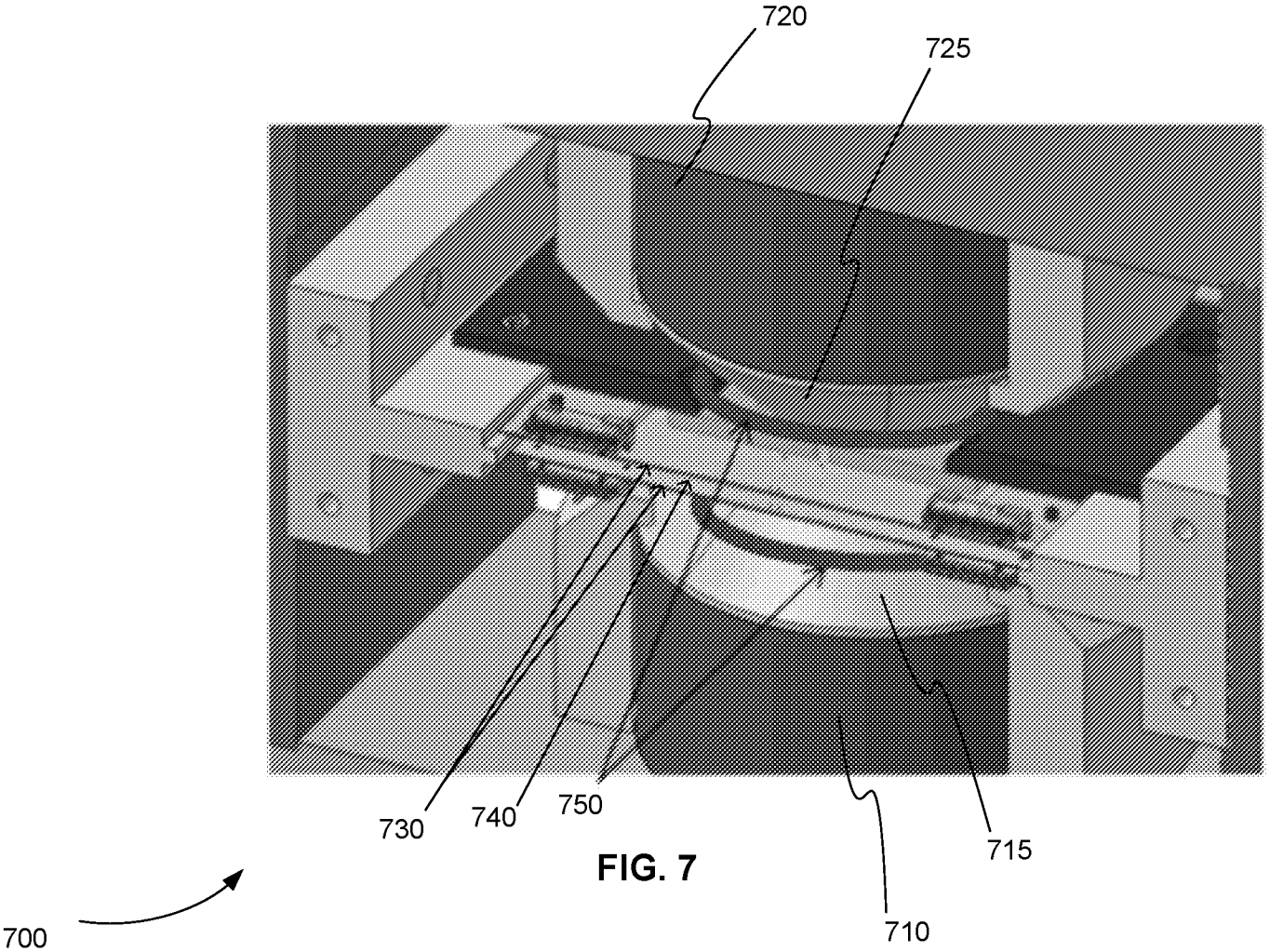
FIG. 7 is a three-dimensional oblique view of a side-on injection Penning trap showing how two solenoid coils are attached to two magnetic pole pieces to stabilize the magnetic field in response to a magnetic field sensor measurement, in accordance with various embodiments.

FIG. 7 is a three-dimensional oblique view 700 of a side-on injection Penning trap showing how two solenoid coils are attached to two magnetic pole pieces to stabilize the magnetic field in response to a magnetic field sensor measurement, in accordance with various embodiments. The side-on injection Penning trap includes two permanent magnets 710 and 720. Permanent magnet 710 includes a tapered or cone shaped pure iron piece 715 that faces a similar tapered or cone shaped pure iron piece 725 of permanent magnet 720. The tapered or cone shaped pure ion pieces 715 and 725 amplify or focus the magnet field between permanent magnet 710 and permanent magnet 720.

The magnet field strength between permanent magnet 710 and permanent magnet 720 is determined by the grade of the magnet material, size (radius and thickness) and the gap distance between permanent magnet 710 and permanent magnet 720. For ion trapping, the gap is preferably wide, but this makes field strength and field uniformity worse. Permanent magnet 710 and permanent magnet 720 can be, for example, N52 grade neodymium magnets (present strongest). The radius and the thickness of theses magnets can be 3" and 1", the facing radius of these magnets can be 1" (25 mm), and the gap distance between these magnets can be 5 mm, for example.

The gap between permanent magnet 710 and permanent magnet 720 includes two parallel PCBs 730 separated by ion trapping gap 740. Each of the two PCBs 730 includes PCB electrodes (not visible in view 700), like PCB electrodes 520 of FIG. 5. The electrodes of PCBs 730 face each other in ion trapping gap 740. The magnetic field produced by permanent magnet 710 and permanent magnet 720 and the quadrupole DC field produced by the electrodes of PCBs 730 trap ions in ion trapping gap 740.

At least one of two PCBs 730 also includes a magnetic field sensor (not visible in view 700), like magnetic field sensor 510 of FIG. 5. As described above, the magnetic field sensor measures the strength of the magnetic field in or near ion trapping gap 740. In order to stabilize the field in response to this measurement, the side-on injection Penning trap further includes two solenoid coils 750. One coil is wound around cone shaped end 715 of permanent magnet 710 and the other coil is wound around cone shaped end 725 of permanent magnet 720. By winding solenoid coils 750 around the permanent magnets, they also become electromagnets that are coaxial with permanent magnets 710 and 720.

Solenoid coils 750 are driven by an electric current source. The current in both coils is parallel. By increasing or decreasing the current in the coils, the field strength in ion trapping gap 740 is increased or decreased.

On skilled in the art can appreciate that winding solenoid coils 750 around the permanent magnets 710 and 720 in FIG. 7 is just one exemplary configuration of using solenoid coils. In various alternative embodiments, only one solenoid coil can be used, or more than two solenoid coils can be used. Also, in various alternative embodiments, one or more coils can be wound around other parts of one or more permanent magnets or can be placed apart from the one or more permanent magnets while still coaxial with the one or more permanent magnets.

Figure 8:
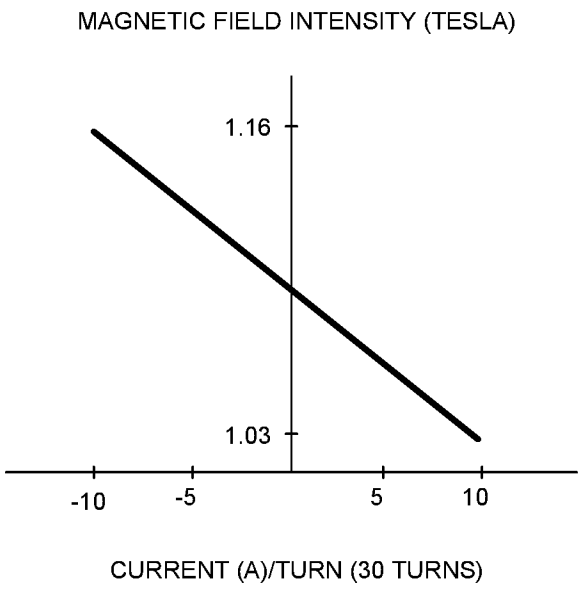
FIG. 8 is an exemplary plot of the magnetic field intensity of a side-on injection Penning trap versus the current/turn applied to two 30 turn solenoid coils, which shows that the magnetic field intensity of the side-on injection Penning trap can be varied linearly between 1.03 Tesla and 1.16 Tesla by varying the current applied to the solenoid coils between 10 and −10 A, in accordance with various embodiments.

FIG. 8 is an exemplary plot 800 of the magnetic field intensity of a side-on injection Penning trap versus the current/turn applied to two 30 turn solenoid coils, which shows that the magnetic field intensity of the side-on injection Penning trap can be varied linearly between 1.03 Tesla and 1.16 Tesla by varying the current applied to the solenoid coils between 10 and −10 A, in accordance with various embodiments. Plot 800 was produced by simulating the magnetic field strength at the trap center of the side-on injection Penning trap of FIG. 7, for example. Plot 800 shows that the magnetic field strength in the trap can be stabilized using solenoid coils that provide feedback control in response to field strength measurements from a magnetic field sensor.

The feedback control from one or magnetic sensors to a current source controlling one or more solenoid coils can be accomplished using a dedicated analog or digital circuit, for example. In various alternative embodiments, the feedback control from one or magnetic sensors to a current source controlling one or more solenoid coils can be accomplished using a processor of the side-on injection Penning trap, a dedicated microcontroller or a dedicated computer system, such as the computer system of FIG. 4.

System for Stabilizing the Magnetic Field

Figure 9:
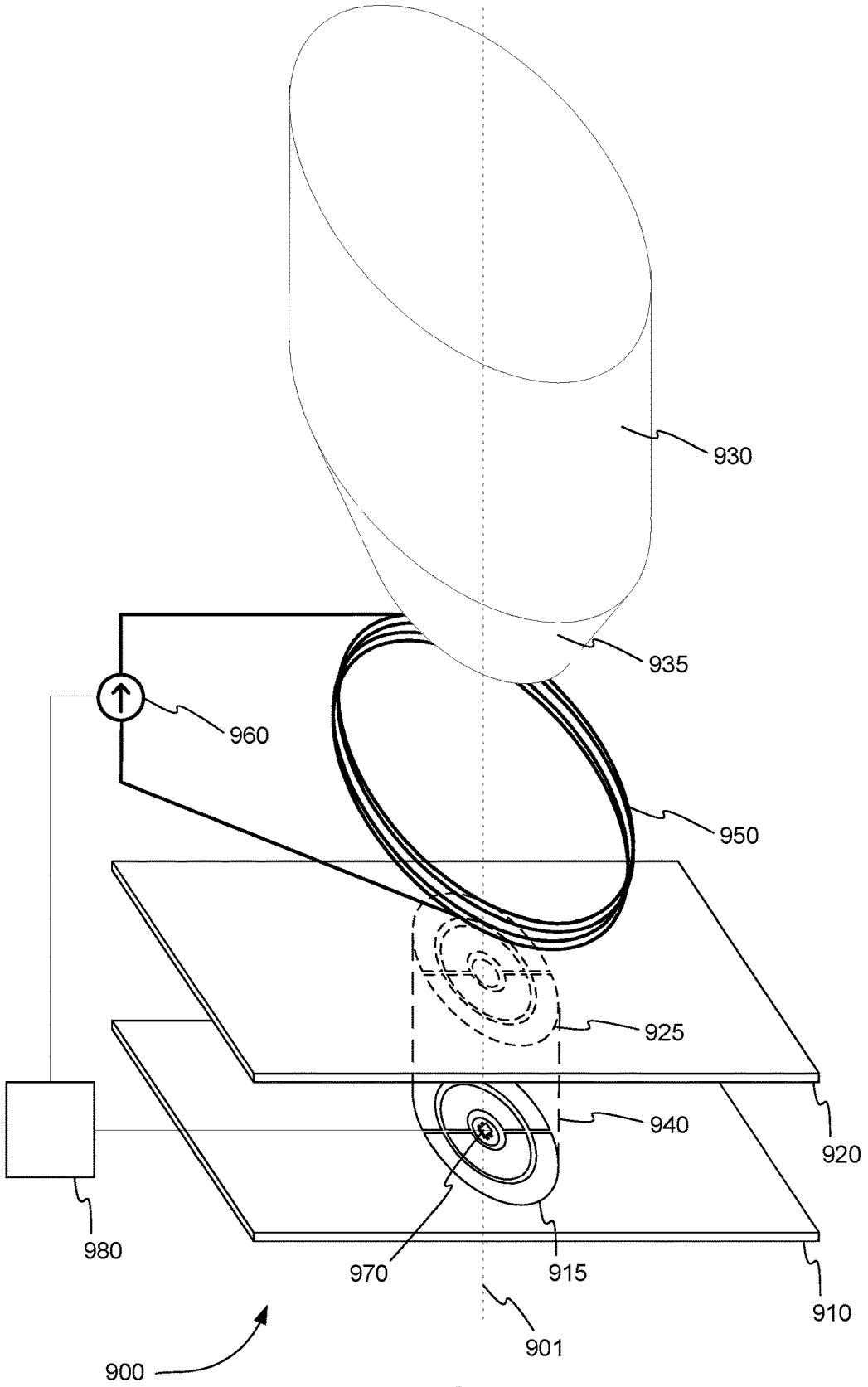
FIG. 9 is an exploded, oblique, and three-dimensional view of a side-on injection Penning trap that includes feedback control for stabilizing the magnetic field applied to ions, in accordance with various embodiments.

FIG. 9 is an exploded, oblique, and three-dimensional view 900 of a side-on injection Penning trap that includes feedback control for stabilizing the magnetic field applied to ions, in accordance with various embodiments. The side-on injection Penning trap includes first PCB 910. A first set of two or more concentric circular or semi-circular electrodes 915 is printed on first PCB 910. The side-on injection Penning trap also includes second PCB 920. A second set of two or more concentric circular or semi-circular electrodes 925 is printed on second PCB 920. Second PCB 920 is placed in parallel with first PCB 910 so that second set of electrodes 925 faces and is coaxial with first set of electrodes 915. Second set of electrodes 925 correspond in shape and size with first set of electrodes 915. Second set of electrodes 925 and first set of electrodes 915 share axis 901, for example. First set of electrodes 915 and second set of electrodes 925 each includes a central disk electrode and one or more concentric segmented ring or arch electrodes, for example.

The space between first set of electrodes 915 and the second set of electrodes 925 is a cylindrical gap 940 used to trap charged particles. First set of electrodes 915 and second set of electrodes 925 apply a quadrupole electric field to cylindrical gap 940. First set of electrodes 915 and second set of electrodes 925 are electrically connected to one or more voltage sources (not shown), for example.

The side-on injection Penning trap further includes at least one permanent magnet 930. At least one permanent magnet 930 is placed coaxially, along axis 901, with first set of electrodes 915 and second set of electrodes 925, but outside of the cylindrical gap 940. At least one permanent magnet 930 applies a first magnetic field to cylindrical gap 940 that is coaxial with the cylindrical gap 940. In a preferred embodiment, two permanent magnets (as shown in FIGS. 2 and 7) are used to apply the magnetic field to cylindrical gap 940. At least one permanent magnet 930 can include a tapered or cone pure iron piece 935 to amplify or focus the magnetic field. The effects of the first magnetic field and the quadrupole electric field combine to trap charged particles in the cylindrical gap 940 that are injected in a direction perpendicular to the first magnetic field. Because the charged particles are injected in the side of cylindrical gap 940, the Penning trap is called a side-on injection Penning trap.

In order to stabilize the magnetic field applied in the cylindrical gap 940, the side-on injection Penning trap also includes at least one solenoid coil 950, current source 960, at least one magnetic sensor 970, and feedback control circuitry 980. At least one solenoid coil 950 is placed coaxially with cylindrical gap 940, but outside of cylindrical gap 940. Current source 960 is electrically connected to at least one solenoid coil 950. Current source 960 supplies current to at least one solenoid coil 950 to produce a second magnetic field that is applied to cylindrical gap 940 that is coaxial with cylindrical gap 940.

At least one magnetic sensor 970 is placed in or on PCB 910 within first set of electrodes 915, for example. Alternatively, at least one magnetic sensor 970 can be placed in or on second PCB 920 within second set of electrodes 925, for example. At least one magnetic sensor 970 measures a combined magnetic field that is a combination of the first magnetic field and the second magnetic field. At least one magnetic sensor 970 is, for example, a Hall effect sensor.

Feedback control circuitry 980 is electrically connected to at least one magnetic sensor 970 and current source 960. Feedback control circuitry 980 receives over time the combined magnetic field measured by at least one magnetic sensor 970. In response, feedback control circuitry 980 adjusts the current of current source 960 to increase or decrease the second magnetic field in order to maintain the combined magnetic field at a constant value. Feedback control circuitry 980 can include, but is not limited to, an analog circuit, a digital circuit, a microcontroller, or a processor (or computer system, such as the computer system of FIG. 4) also used to control the quadrupole electric field.

In various embodiments, the charged particles comprise ions and the side-on injection Penning trap is used in Fourier transform ion cyclotron resonance (FT-ICR) mass spectrometry.

Method for Stabilizing the Magnetic Field

Figure 10:
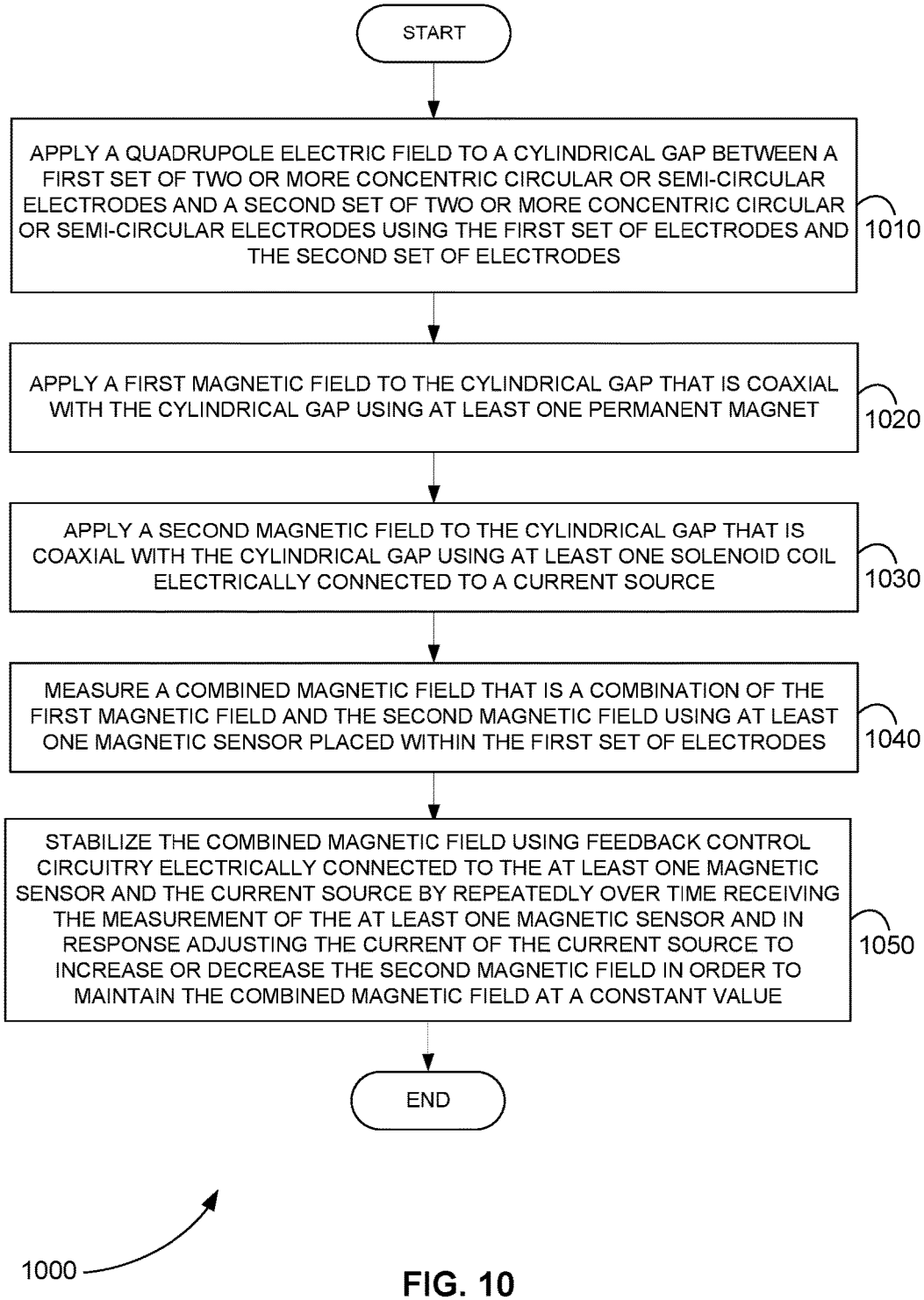
FIG. 10 is a flowchart showing a method for stabilizing the magnetic field applied to ions in a side-on injection Penning trap, in accordance with various embodiments.

FIG. 10 is a flowchart 1000 showing a method for stabilizing the magnetic field applied to ions in a side-on injection Penning trap, in accordance with various embodiments.

In step 1010 of flowchart 1000, a quadrupole electric field is applied to a cylindrical gap between a first set of two or more concentric circular or semi-circular electrodes and a second set of two or more concentric circular or semi-circular electrodes using the first set of electrodes and the second set of electrodes. The second set of electrodes correspond in shape and size with the first set of electrodes. The first set of electrodes is printed on a first printed circuit board and the second set of electrodes is printed on a second printed circuit board. The second printed circuit board is placed in parallel with the first printed circuit board so that the second set of electrodes faces and is coaxial with the first set of electrodes. The space between the first set of electrodes and the second set of electrodes is the cylindrical gap used to trap charged particles.

In step 1020, a first magnetic field is applied to the cylindrical gap that is coaxial with the cylindrical gap using at least one permanent magnet. The at least one permanent magnet is placed coaxially with the first set of electrodes and the second set of electrodes but outside of the cylindrical gap. The effects of the first magnetic field and the quadrupole electric field combine to trap charged particles in the cylindrical gap that are injected in a direction perpendicular to the first magnetic field.

In step 1030, a second magnetic field is applied to the cylindrical gap that is coaxial with the cylindrical gap using at least one solenoid coil electrically connected to a current source. The current source supplies current to the at least one solenoid coil to produce a second magnetic field. The at least one solenoid coil is placed coaxially with the cylindrical gap, but outside of the cylindrical gap.

In step 1040, a combined magnetic field that is a combination of the first magnetic field and the second magnetic field is measured using at least one magnetic sensor placed within the first set of electrodes. The at least one magnetic sensor is placed in or on the first printed circuit board, for example.

In step 1050, the combined magnetic field is stabilized using feedback control circuitry electrically connected to the at least one magnetic sensor and the current source. The magnetic field is stabilized by repeatedly over time receiving the measurement of the at least one magnetic sensor and in response adjusting the current of the current source to increase or decrease the second magnetic field in order to maintain the combined magnetic field at a constant value.

Improvements to the Quality of the Quadrupole Field

As described above, a pure quadrupole field cannot be formed using electrodes printed on a PCB. A truly quadrupole field can only be formed using quadrupole electrodes, which cannot be used in the small gap of a side-on injection Penning trap. In various embodiments, however, PCB electrodes are optimized to provide an improved quadrupole field in the narrow gap between two PCBs.

Figure 11:
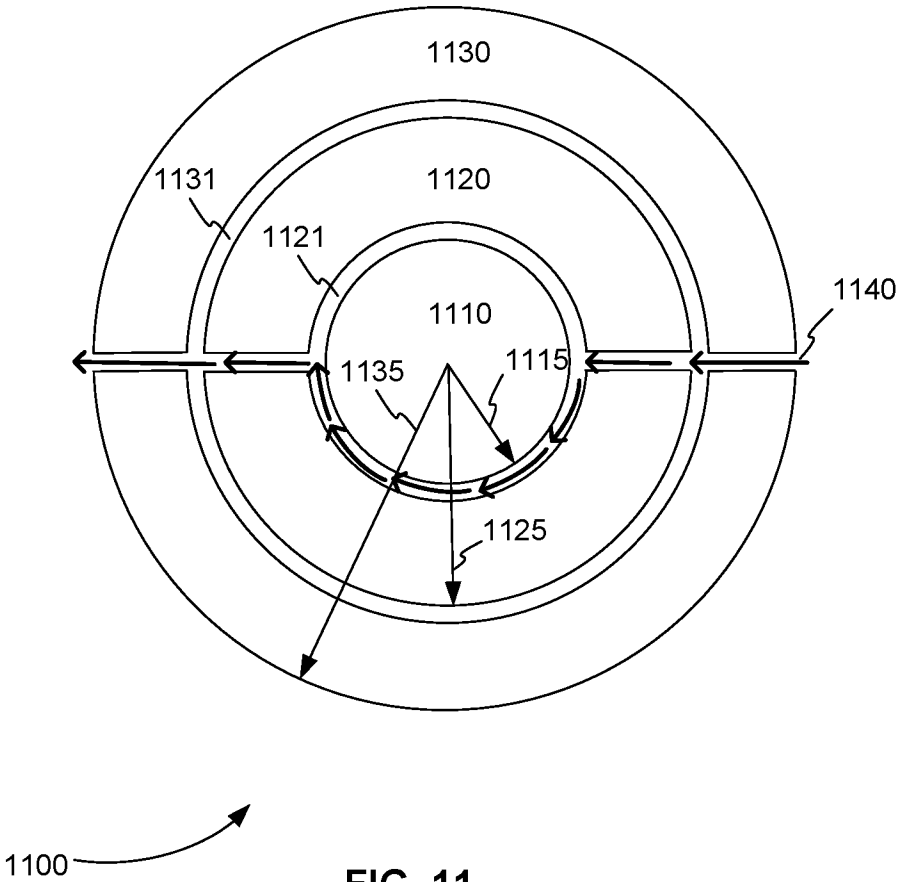
FIG. 11 is a top view of a set of PCB electrodes used in a side-on injection Penning trap that are optimized to provide an improved quadrupole field, in accordance with various embodiments.

FIG. 11 is a top view 1100 of a set of PCB electrodes used in a side-on injection Penning trap that are optimized to provide an improved quadrupole field, in accordance with various embodiments. The basic structure of the set of PCB electrodes shown in FIG. 11 was previously disclosed in the '459 Application. This set of PCB electrodes includes central disk electrode 1110 and two concentric ring electrodes 1120 and 1130 surrounding central disk electrode 1110. There is circular non-conducting space (1121 and 1131) between each of these electrodes. In addition, the two concentric ring electrodes 1120 and 1130 are each segmented by non-conducting space forming two half rings or arches that have the same area.

As described above, ions trace a path through the side-on injection Penning trap following the non-conducting spaces, as shown by arrows 1140. Note that the path depicted by arrows 1140 is just one possible path. Depending on how central disk electrode 1110 and the half rings of the two concentric ring electrodes 1120 and 1130 are biased, the ions can trace almost any path following non-conducting spaces.

Optimized PCB Electrodes

Although the structure of the set of PCB electrodes shown in FIG. 11 was previously disclosed, the dimensions needed to produce an optimum quadrupole field were not provided. In a first embodiment, the optimum radial dimensions of the disk and rings of a set of PCB electrodes for a side-on injection Penning trap are provided. For example, the values for radii 1115, 1125, and 1135 of FIG. 11 are found. These optimum radial dimensions allow the trap to produce an improved quadrupole field.

The optimum radial dimensions of the two sets of PCB electrodes of a trap are found by simulating the electric field in the gap between them. The two sets of PCB electrodes form a cylindrical gap.

Figure 12:
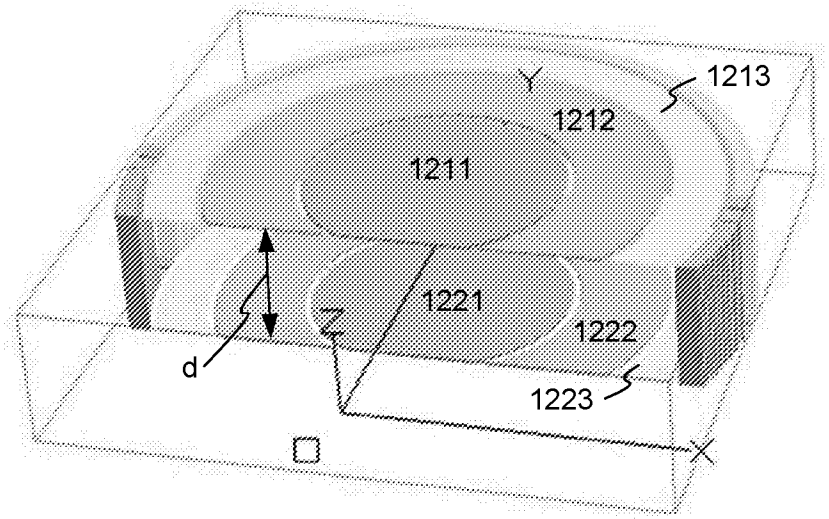
FIG. 12 is a three-dimensional oblique view of the cylindrical gap between two sets of PCB electrodes of a side-on injection Penning trap, in accordance with various embodiments.

FIG. 12 is a three-dimensional oblique view 1200 of the cylindrical gap between two sets of PCB electrodes of a side-on injection Penning trap, in accordance with various embodiments. The first set of PCB electrodes includes central disk electrode 1211 and two concentric ring electrodes 1212 and 1213. The second set of PCB electrodes includes central disk electrode 1221 and two concentric ring electrodes 1222 and 1223. Central disk electrodes 1211 and 1221 are used as the end cap electrodes, for example.

From the simulations, the optimum radial dimensions for the electrodes of each set of PCB electrodes are found as a function of the length, d, of the cylindrical gap. The optimum radius of the central disk is found to be 1.1 d, the optimum outer radius of the first concentric ring is found to be 1.9 d, and the optimum outer radius of the second concentric ring is found to be 2.4 d.

Figure 13:
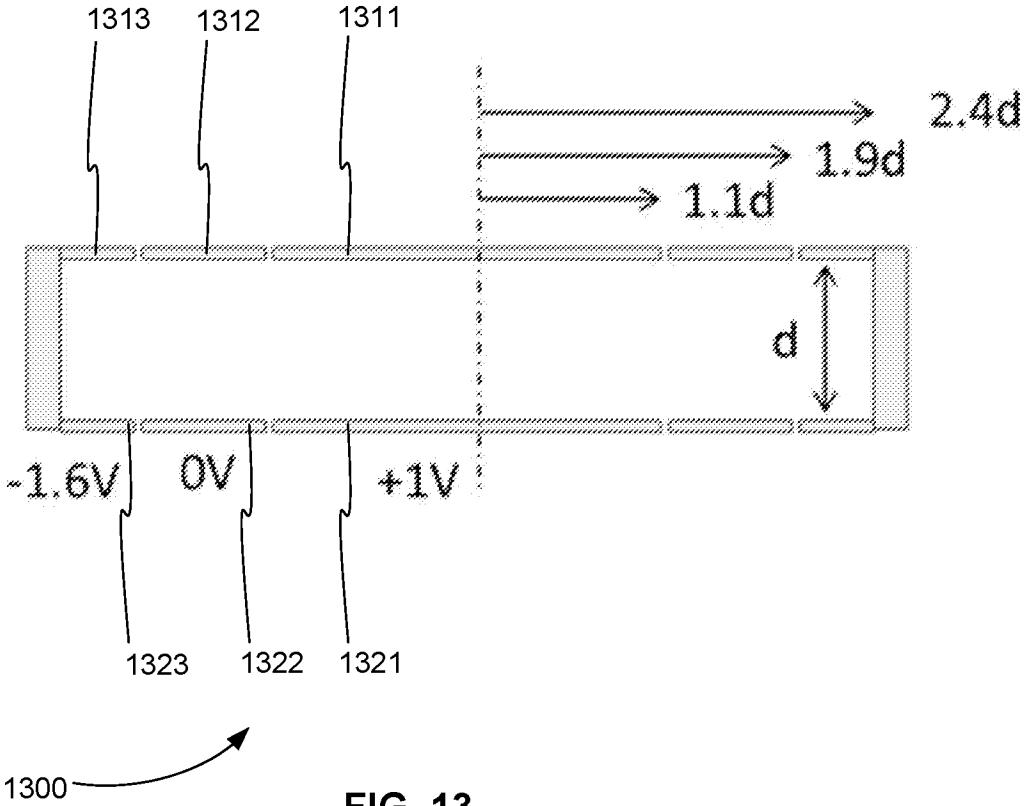
FIG. 13 is a two-dimensional side view of the cylindrical gap between two sets of PCB electrodes of a side-on injection Penning trap showing the optimal radial dimensions of the electrodes, in accordance with various embodiments.

FIG. 13 is a two-dimensional side view 1300 of the cylindrical gap between two sets of PCB electrodes of a side-on injection Penning trap showing the optimal radial dimensions of the electrodes, in accordance with various embodiments. The first set of PCB electrodes includes central disk electrode 1311 and two concentric ring electrodes 1312 and 1313. The second set of PCB electrodes includes central disk electrode 1321 and two concentric ring electrodes 1322 and 1323.

Figure 14:
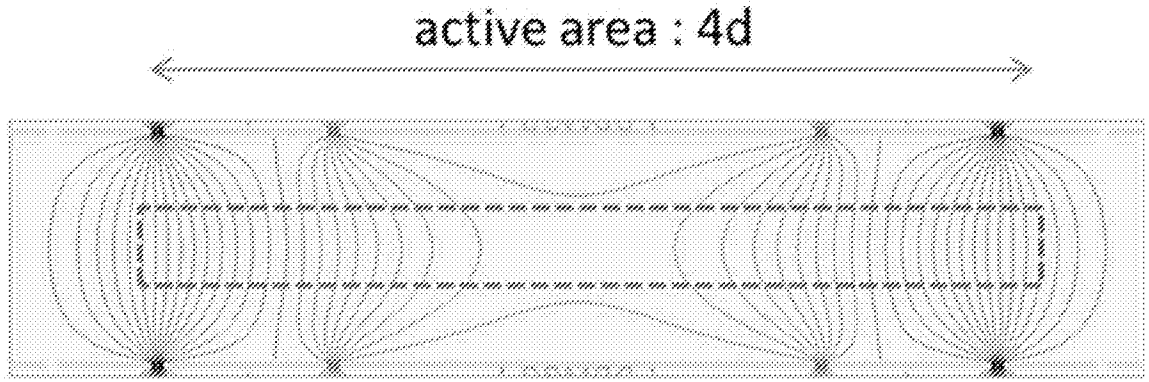
FIG. 14 is a two-dimensional side view of the quadrupole electric field produced in the cylindrical gap between two sets of PCB electrodes of a side-on injection Penning trap using the optimal radial dimensions shown in FIG. 13, in accordance with various embodiments.

FIG. 14 is a two-dimensional side view 1400 of the quadrupole electric field produced in the cylindrical gap between two sets of PCB electrodes of a side-on injection Penning trap using the optimal radial dimensions shown in FIG. 13, in accordance with various embodiments. FIG. 14 shows that a quadrupole field can be produced using only two sets of PCB electrodes.

System for Improving a Quadrupole Field with Optimized PCB Electrodes

Figure 15:
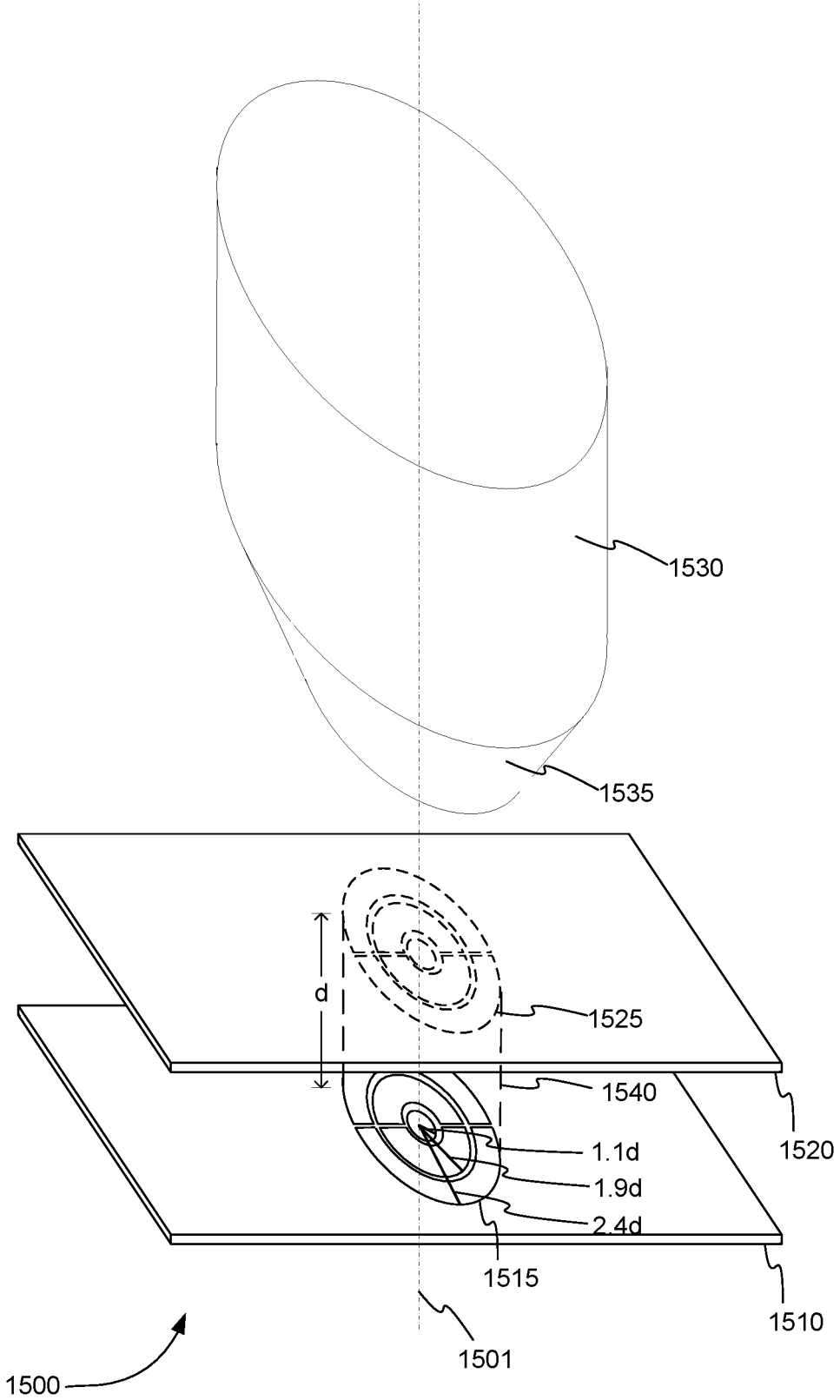
FIG. 15 is an exploded, oblique, and three-dimensional view of a side-on injection Penning trap that includes two sets of PCB electrodes with radial dimensions that are optimized to apply a quadrupole field to ions, in accordance with various embodiments.

FIG. 15 is an exploded, oblique, and three-dimensional view 1500 of a side-on injection Penning trap that includes two sets of PCB electrodes with radial dimensions that are optimized to apply a quadrupole field to ions, in accordance with various embodiments. The side-on injection Penning trap includes first PCB 1510. A first set of two or more concentric circular or semi-circular electrodes 1515 is printed on first PCB 1510. The side-on injection Penning trap also includes second PCB 1520. A second set of two or more concentric circular or semi-circular electrodes 1525 is printed on second first PCB 1520. Second PCB 1520 is placed in parallel with first PCB 1510 so that second set of electrodes 1525 faces and is coaxial with first set of electrodes 1515. Second set of electrodes 1525 and first set of electrodes 1515 share axis 1501, for example.

The space between first set of electrodes 1515 and the second set of electrodes 1525 is a cylindrical gap 1540 used to trap charged particles. Cylindrical gap 1540 has a length d. First set of electrodes 1515 and second set of electrodes 1525 each includes a central disk electrode with a radius of 1.1 d, a first concentric ring or segmented ring electrode of radius 1.9 d, and a second concentric ring or segmented ring electrode of radius 2.4 d. First set of electrodes 1515 and second set of electrodes 1525 apply a quadrupole electric field to cylindrical gap 1540. First set of electrodes 1515 and second set of electrodes 1525 are electrically connected to one or more voltage sources (not shown), for example.

The side-on injection Penning trap further includes at least one permanent magnet 1530. At least one permanent magnet 1530 is placed coaxially, along axis 1501, with first set of electrodes 1515 and second set of electrodes 1525, but outside of the cylindrical gap 1540. At least one permanent magnet 1530 applies a first magnetic field to cylindrical gap 1540 that is coaxial with the cylindrical gap 1540. In a preferred embodiment, two permanent magnets (as shown in FIGS. 2 and 7) are used to apply the magnetic field to cylindrical gap 1540. At least one permanent magnet 1530 can include a tapered or cone end 1535 to amplify or focus the magnetic field. The effects of the first magnetic field and the quadrupole electric field combine to trap charged particles in the cylindrical gap 1540 that are injected in a direction perpendicular to the first magnetic field.

In various embodiments, the charged particles comprise ions and the side-on injection Penning trap is used in Fourier transform ion cyclotron resonance (FT-ICR) mass spectrometry.

In various embodiments, the side-on injection Penning trap can further include a system to stabilize the magnetic field applied in the cylindrical gap 1540 analogous to the system shown in FIG. 9. The system to stabilize the magnetic field shown in FIG. 9 includes at least one solenoid coil 950, current source 960, at least one magnetic sensor 970, and feedback control circuitry 980.

Ideal Equipotential Surface Electrode

In another embodiment (a preferred embodiment), the central disk electrodes of the two opposing sets of electrodes are replaced with cones extending into the gap and that intersect at their apexes. Together these two intersecting cones provide an ideal equipotential surface that crosses the center of the ion trap.

Figure 16:
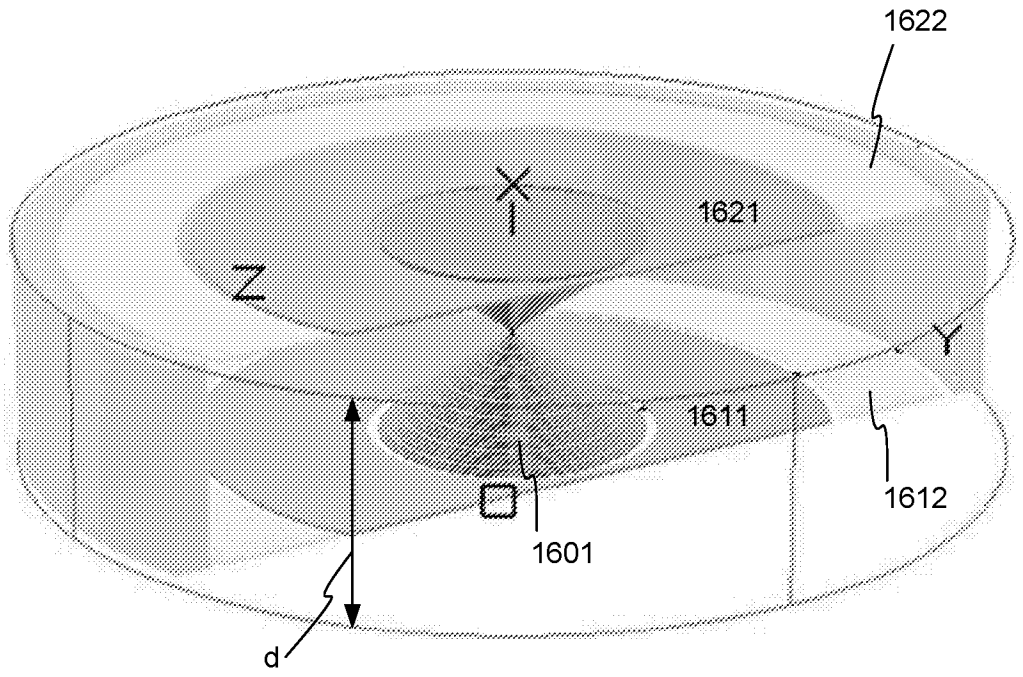
FIG. 16 is a three-dimensional oblique view of the cylindrical gap between two sets of PCB electrodes of a side-on injection Penning trap that includes an equipotential surface electrode formed from two cones that intersect at their apexes that is located in the center of the trap, in accordance with various embodiments.

FIG. 16 is a three-dimensional oblique view 1600 of the cylindrical gap between two sets of PCB electrodes of a side-on injection Penning trap that includes an equipotential surface electrode formed from two cones that intersect at their apexes that is located in the center of the trap, in accordance with various embodiments. Equipotential surface electrode 1601 is formed from two cones that intersect at their apexes. Each end of equipotential surface electrode 1601 is secured to a PCB and is encircled by a set of two or more ring or segmented ring electrodes. The shape of each cone of equipotential surface electrode 1601 is, for example, an ideal cone with a ratio of radius to height given by the square root of two.

Equipotential surface electrode 1601 is placed at the center of the trap and is coaxial with cylindrical gap of the trap. Note that equipotential surface electrode 1601 cannot be used in a Paul trap of conventional radio frequency (RF) ion trap system, because the stability point of ions for such systems is at the trap center. In a side-on injection FT-ICR system, however, ions have a cyclic motion around the center axis and the ions do not reach the trap center, so an electrode can be placed along central axis trap and can even extend to the trap center.

In general, at least two electrode surfaces are required to construct a quadrupole field. Equipotential surface electrode 1601 provides one ideal surface. Another surface is provided by PCB ring or segmented ring electrodes 1611, 1612, 1621, and 1622. PCB electrodes 1611 and 1612 are printed on one PCB, and PCB electrodes 1621 and 1622 are printed on the other PCB. Inner PCB electrodes 1611 and 1621 are used as induced current pick up detectors for FT-ICR measurement and may be biased to ground, for example. Outer PCB electrodes 1612 and 1621 are used to form a precise quadrupole field, for example. Inner PCB electrodes 1611 and 1621 and outer PCB electrodes 1612 and 1621 are segmented to provide ion paths.

As described above, simulations can be used to optimize the dimensions of equipotential surface electrode 1601 and PCB ring or segmented ring electrodes 1611, 1612, 1621, and 1622. These dimensions can also be expressed as a function of the length, d, of the cylindrical gap.

In one exemplary simulation, the gap length, d, is set to 5 mm. The parameter obtained from the simulation is the outer radius of the inner ring electrode that gives the best quadrupole. The equipotential surface electrode 1601 is biased at +1V, and the DC voltages on the inner PCB electrodes 1611 and 1621 and the DC voltages on the outer PCB electrodes 1612 and 1622 were swept to find the most quadratic field using an electric field simulator. A calculated electric potential along the center plane (ions are trapped near this plane) is fitted by a function, $r^x$, where x is a parameter to evaluate quadrupole resemblance. To find an optimal radius, residue values after fitting are calculated for each of the ring voltage values. Residue is the squared difference between perfect quadrupole and the simulate field. At a radius of 0.85 d, minimum residue was given. A set of resulting radial dimensions are found.

Figure 17:
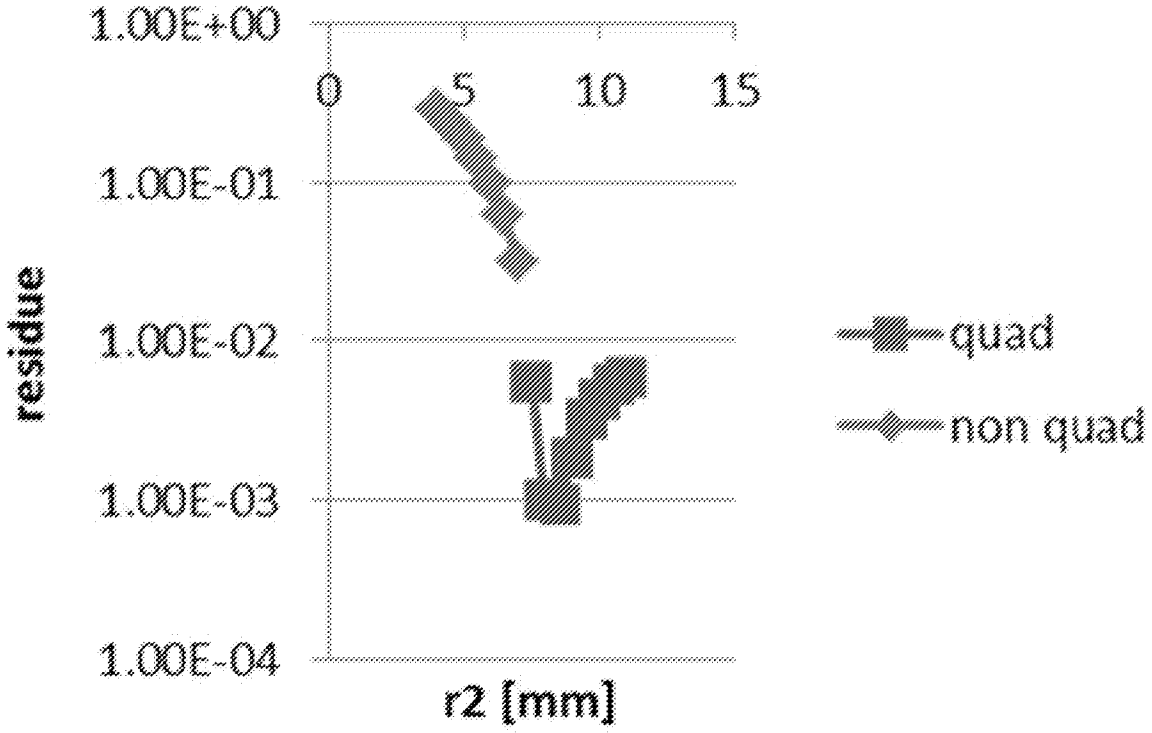
FIG. 17 is an exemplary plot of residue values that were simulated using different radiuses of the outer ring electrodes of the PCB electrodes, in accordance with various embodiments.

FIG. 17 is an exemplary plot 1700 of residue values that were simulated using different radiuses of the outer ring electrodes of the PCB electrodes, in accordance with various embodiments. Plot 1700 shows that there is no quadrupole solution when the inner ring electrode radius is too small using any value of applied voltage on the two rings. It also shows that when the ring radius is bigger than 4.0 mm (or 1.6 d), quadrupole solutions do exist.

Figure 18:
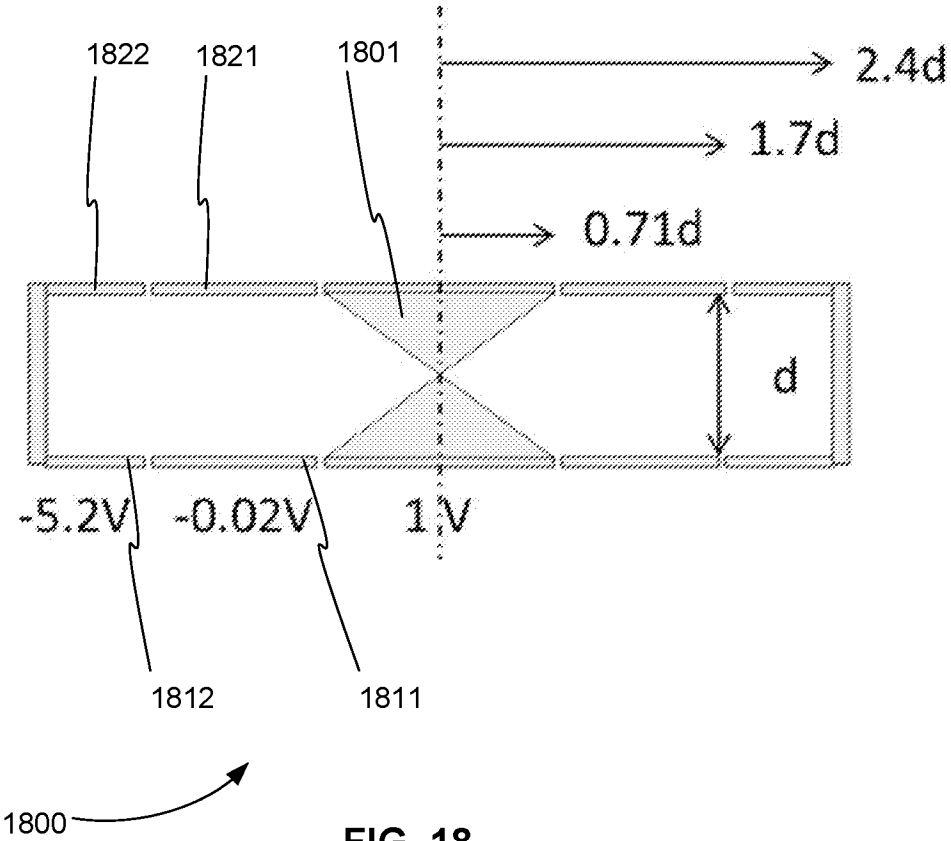
FIG. 18 is a two-dimensional side view of the cylindrical gap between two sets of PCB electrodes of a side-on injection Penning trap that includes an equipotential surface electrode formed from two cones that intersect at their apexes that is located in the center of the trap showing exemplary optimal radial dimensions of the electrodes, in accordance with various embodiments.

FIG. 18 is a two-dimensional side view 1800 of the cylindrical gap between two sets of PCB electrodes of a side-on injection Penning trap that includes an equipotential surface electrode formed from two cones that intersect at their apexes that is located in the center of the trap showing exemplary optimal radial dimensions of the electrodes, in accordance with various embodiments. These radial dimensions are exemplary, because they depend on the outer radius of the outer ring electrode as well as the existence of the wall connecting the two PCBs. The trap includes equipotential surface electrode 1801 and PCB ring or segmented ring electrodes 1811, 1812, 1821, and 1822.

Figure 19:
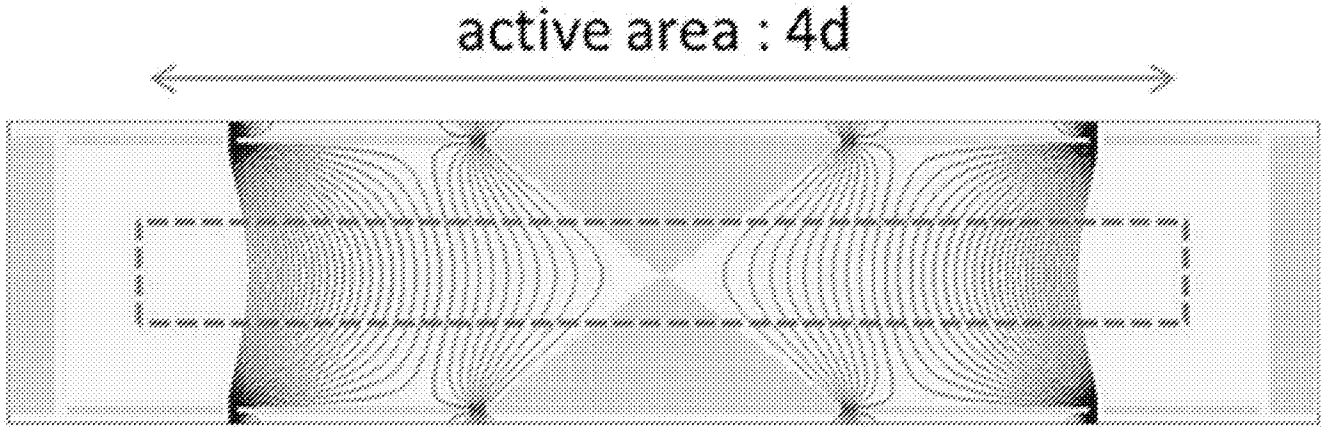
FIG. 19 is a two-dimensional side view of the quadrupole electric field produced in the cylindrical gap between two sets of PCB electrodes of a side-on injection Penning trap that includes an equipotential surface electrode formed from two cones that intersect at their apexes that is located in the center of the trap using the optimal radial dimensions shown in FIG. 18, in accordance with various embodiments.

FIG. 19 is a two-dimensional side view 1400 of the quadrupole electric field produced in the cylindrical gap between two sets of PCB electrodes of a side-on injection Penning trap that includes an equipotential surface electrode formed from two cones that intersect at their apexes that is located in the center of the trap using the optimal radial dimensions shown in FIG. 18, in accordance with various embodiments. A comparison of FIG. 19 with FIG. 13 shows that the use of the equipotential surface electrode greatly improves the quadrupole field over using PCB electrodes alone.

System for Improving a Quadrupole Field with Equipotential Surface Electrode

Figure 20:
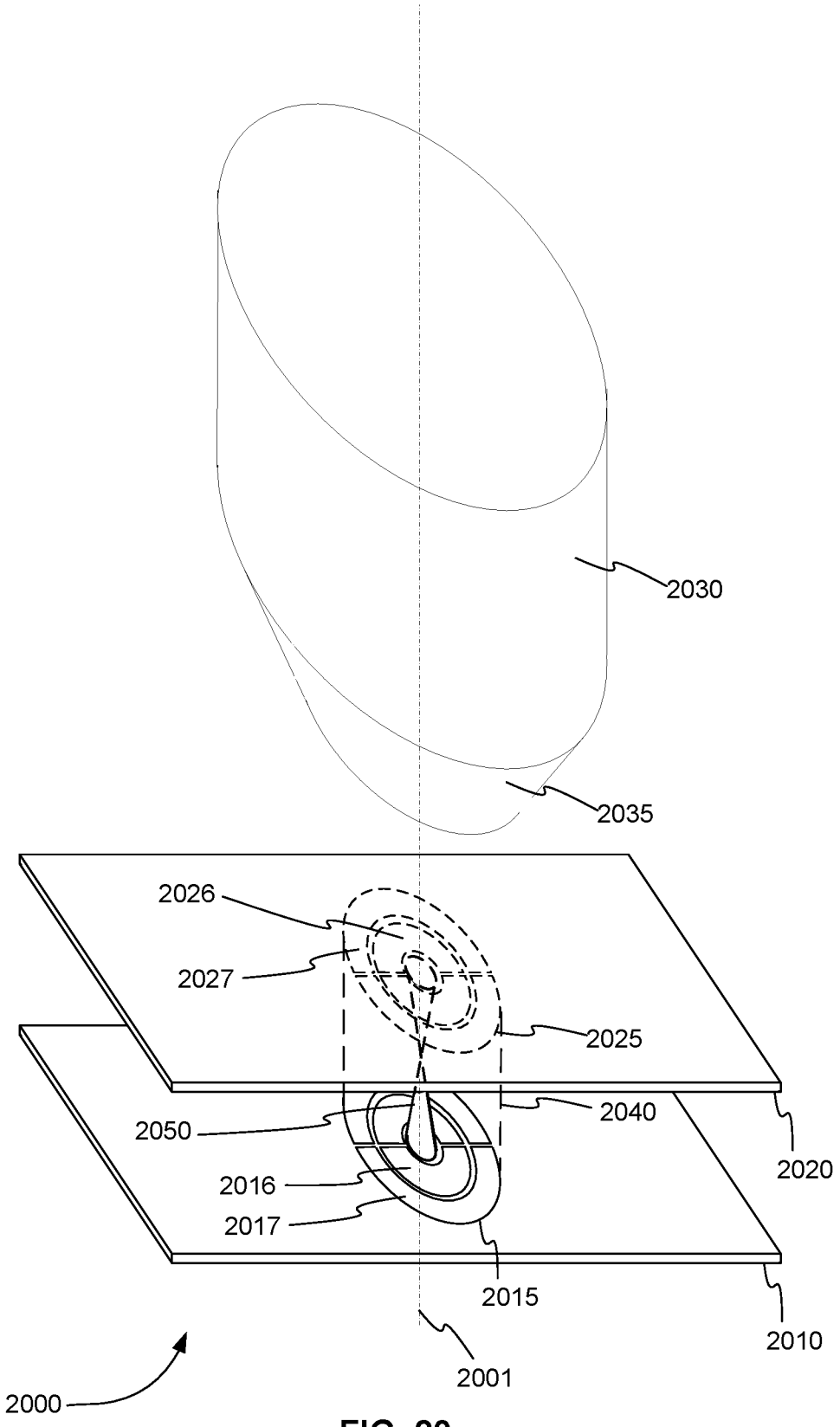
FIG. 20 is an exploded, oblique, and three-dimensional view of a side-on injection Penning trap that includes two sets of PCB electrodes and an equipotential surface electrode that is placed between the two sets of PCB electrodes, in accordance with various embodiments.

FIG. 20 is an exploded, oblique, and three-dimensional view 2000 of a side-on injection Penning trap that includes two sets of PCB electrodes and an equipotential surface electrode that is placed between the two sets of PCB electrodes, in accordance with various embodiments. The side-on injection Penning trap includes first PCB 2010. A first set of two or more concentric circular or semi-circular electrodes 2015 is printed on first printed circuit board 2010. The side-on injection Penning trap also includes second PCB 2020. A second set of two or more concentric circular or semi-circular electrodes 2025 is printed on second PCB 2020. Second PCB 2020 is placed in parallel with first PCB 2010 so that second set of electrodes 2025 faces and is coaxial with first set of electrodes 2015. Second set of electrodes 2025 and first set of electrodes 2015 share axis 2001, for example. First set of electrodes 2015 and second set of electrodes 2025 each includes two or more concentric segmented ring or arch electrodes, for example. The space between first set of electrodes 2015 and the second set of electrodes 2025 is a cylindrical gap 2040 used to trap charged particles.

The side-on injection Penning trap further includes equipotential surface electrode 2050 formed from two cones that intersect at their apexes. A first cone end of equipotential surface electrode 2050 is secured to first PCB 2010 in the center of first set of electrodes 2015. A second cone end of equipotential surface electrode 2050 is secured to second PCB in the center of second set of electrodes 2025. Equipotential surface electrode 2050 extends through the center of cylindrical gap 2040 and is coaxial with cylindrical gap 2040. First set of electrodes 2015, the second set of electrodes, 2025 and equipotential surface electrode 2050 apply a quadrupole electric field to cylindrical gap 2040 in the region not occupied by equipotential surface electrode 2050. First set of electrodes 2015, second set of electrodes 2025, and equipotential surface electrode 2050 are electrically connected to one or more voltage sources (not shown), for example.

The side-on injection Penning trap further includes at least one permanent magnet 2030. At least one permanent magnet 2030 is placed coaxially, along axis 2001, with first set of electrodes 2015 and second set of electrodes 2025, but outside of the cylindrical gap 2040. At least one permanent magnet 2030 applies a first magnetic field to the cylindrical gap 2040 that is coaxial with the cylindrical gap 2040. In a preferred embodiment, two permanent magnets (as shown in FIGS. 2 and 7) are used to apply the magnetic field to cylindrical gap 2040. At least one permanent magnet 2030 can include a tapered or cone end 2035 to amplify or focus the magnetic field. The effects of the first magnetic field and the quadrupole electric field combine to trap charged particles in the cylindrical gap 2040 that are injected in a direction perpendicular to the first magnetic field.

In various embodiments, first set of electrodes 2015 includes first inner ring electrode 2016 and first outer ring electrode 2017, and second set of electrodes 2025 includes second inner ring electrode 2026 and second outer ring electrode 2027. First inner ring electrode 2017 and second inner ring electrode 2026 are used together as an induced current detector for FT-ICR measurement, for example. First outer ring electrode 2017 and second outer ring electrode 2027 are used together to form the quadrupole electric field, for example.

In various embodiments, first inner ring electrode 2016, first outer ring electrode 2017, second inner ring electrode 2026, and second outer ring electrode 2027 are segmented so that the segments provide a path for charged particle injection into and ejection from the side-on injection Penning trap in a direction perpendicular to the magnetic field.

In various embodiments, each cone of the equipotential surface electrode 2050 has a ratio of radius to height given by the square root of two.

In various embodiments, the charged particles comprise ions and the side-on injection Penning trap is used in Fourier transform ion cyclotron resonance (FT-ICR) mass spectrometry.

In various embodiments, the side-on injection Penning trap can further include a system to stabilize the magnetic field applied in the cylindrical gap 2040 analogous to the system shown in FIG. 9. The system to stabilize the magnetic field shown in FIG. 9 includes at least one solenoid coil 950, current source 960, at least one magnetic sensor 970, and feedback control circuitry 980.

Four or More Concentric Circular Electrodes for Higher Resolution

In another embodiment, higher resolution is obtained from a side-on injection Penning trap that only includes circular PCB electrodes by increasing the number of electrodes. As described above and as shown in FIG. 3, a side-on injection Penning trap was disclosed in the '459 Application that included three concentric circular or semi-circular PCB electrodes. These electrodes included a central disk electrode, a segmented inner ring electrode and a segment outer ring electrode.

Figure 21:
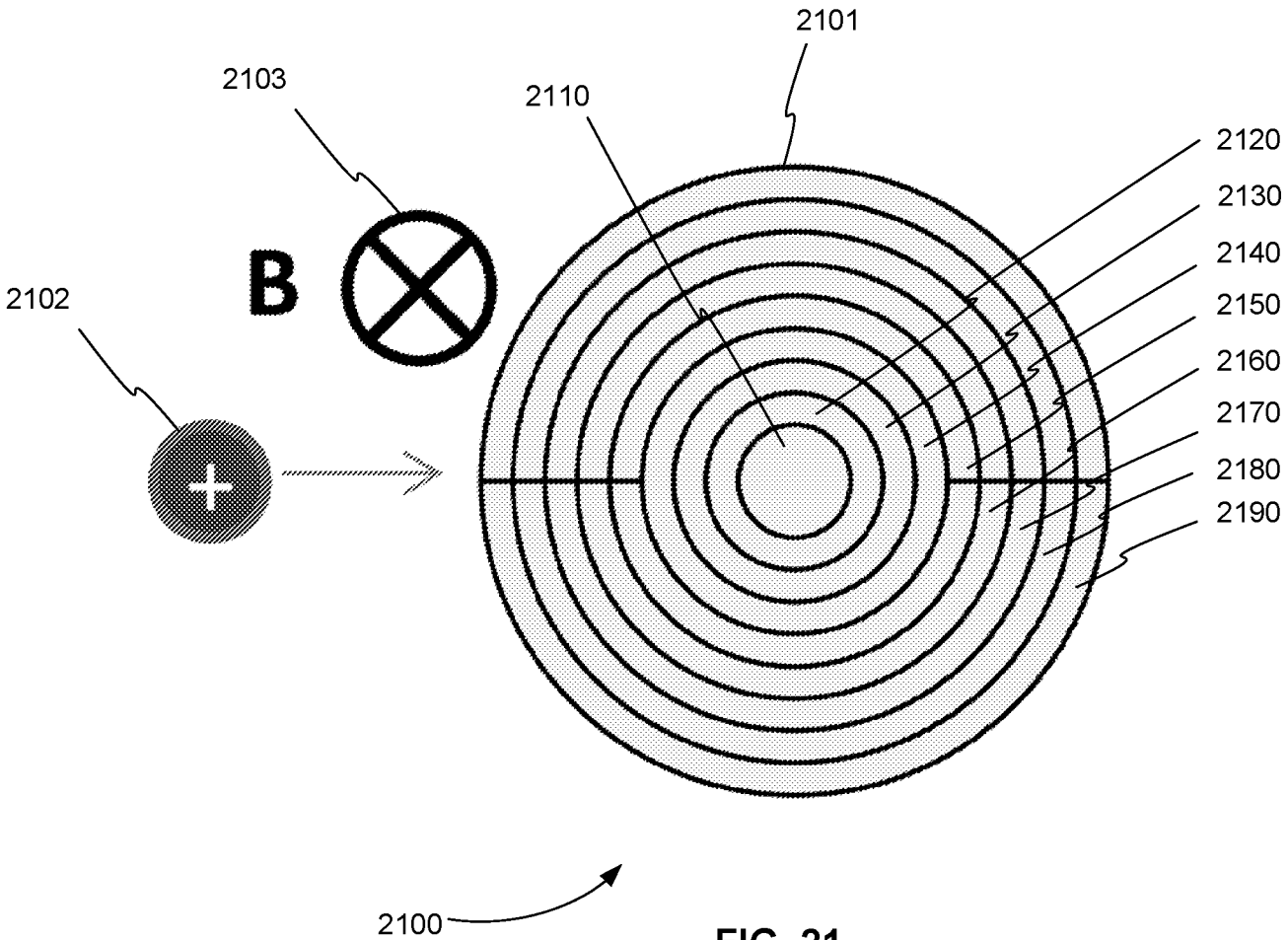
FIG. 21 is a top view of a set of PCB electrodes used in a side-on injection Penning trap that includes four or more concentric circular PCB electrodes to provide higher resolution, in accordance with various embodiments.

FIG. 21 is a top view 2100 of a set of PCB electrodes used in a side-on injection Penning trap that includes four or more concentric circular PCB electrodes to provide higher resolution, in accordance with various embodiments. Set of PCB electrodes 2101 includes nine concentric circular PCB electrodes. Specifically, set of PCB electrodes 2100 includes central disk electrode 2110 and ring electrodes 2120-2190. In addition, ring electrodes 2150-2190 are segmented so that the segments provide a path for a charged particle 2102 to be injected into and ejected from the side-on injection Penning trap in a direction perpendicular to magnetic field 2103.

System for Improving Resolution with Four or More PCB Electrodes

Figure 22:
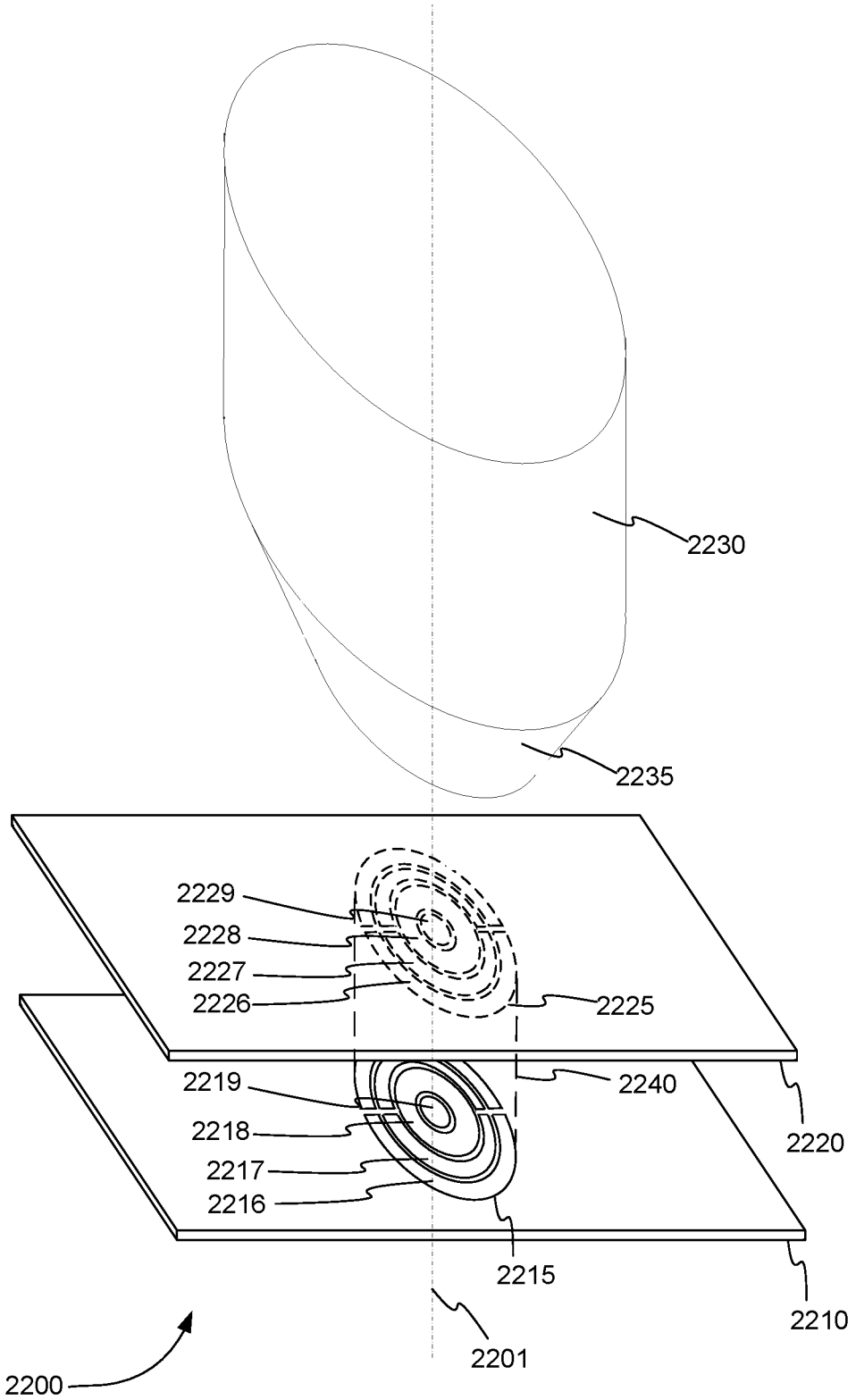
FIG. 22 is an exploded, oblique, and three-dimensional view of a side-on injection Penning trap that includes two sets of PCB electrodes that each includes four or more concentric circular or semi-circular electrodes to improve resolution, in accordance with various embodiments.

FIG. 22 is an exploded, oblique, and three-dimensional view 2200 of a side-on injection Penning trap that includes two sets of PCB electrodes that each include four or more concentric circular or semi-circular electrodes to improve resolution, in accordance with various embodiments.

The side-on injection Penning trap includes first PCB 2210. A first set of four or more concentric circular or semi-circular electrodes 2215 is printed on first printed circuit board 2210. In FIG. 22, first set of electrodes 2215 includes segmented ring electrodes 2216 and 2217, ring electrode 2218, and central disk electrode 2219.

The side-on injection Penning trap also includes second PCB 2220. A second set of four or more concentric circular or semi-circular electrodes 2225 is printed on second PCB 2220. In FIG. 22, second set of electrodes 2225 includes segmented ring electrodes 2226 and 2227, ring electrode 2228, and central disk electrode 2229.

Second PCB 2220 is placed in parallel with first PCB 2210 so that second set of electrodes 2225 faces and is coaxial with first set of electrodes 2215. Second set of electrodes 2225 and first set of electrodes 2215 share axis 2201, for example. First set of electrodes 2215 and second set of electrodes 2225 each includes a central disk electrode and four or more concentric ring or segmented ring electrodes, for example.

The space between first set of electrodes 2215 and the second set of electrodes 2225 is a cylindrical gap 2240 used to trap charged particles. First set of electrodes 2215 and second set of electrodes 2225 apply a quadrupole electric field to cylindrical gap 2240. First set of electrodes 2215 and second set of electrodes 2225 are electrically connected to one or more voltage sources (not shown), for example.

The side-on injection Penning trap further includes at least one permanent magnet 2230. At least one permanent magnet 2230 is placed coaxially, along axis 2201, with first set of electrodes 2215 and second set of electrodes 2225, but outside of the cylindrical gap 2240. At least one permanent magnet 2230 applies a first magnetic field to the cylindrical gap 2240 that is coaxial with the cylindrical gap 2240. In a preferred embodiment, two permanent magnets (as shown in FIGS. 2 and 7) are used to apply the magnetic field to cylindrical gap 2240. At least one permanent magnet 2230 can include a tapered or cone end 2235 to amplify or focus the magnetic field. The effects of the first magnetic field and the quadrupole electric field combine to trap charged particles in the cylindrical gap 2240 that are injected in a direction perpendicular to the first magnetic field.

In various embodiments, the charged particles comprise ions and the side-on injection Penning trap is used in Fourier transform ion cyclotron resonance (FT-ICR) mass spectrometry.

In various embodiments, the side-on injection Penning trap can further include a system to stabilize the magnetic field applied in the cylindrical gap 2240 analogous to the system shown in FIG. 9. The system to stabilize the magnetic field shown in FIG. 9 includes at least one solenoid coil 950, current source 960, at least one magnetic sensor 970, and feedback control circuitry 980.

Segmented Central Disk Electrodes to Bring Charged Particles to the Trap Center

In another embodiment, charged particles are drawn to the center of a side-on injection Penning trap that only includes circular PCB electrodes by segmenting the central disks of the electrodes. As describe above and as shown in FIG. 3, the side-on injection Penning trap the disclosed in the '459 Application used a set of electrodes that included a central disk electrode. The central disk electrode was not segmented, so charged particles or ions could not reach the center of the trap. This was not a problem for the FT-ICR mass spectrometer of the '459 Application, because the spectrometer was designed to give the ions a cyclic motion around the central axis of the trap without reaching the center of the trap. However, for other applications, such as atomic physics, quantum computing, or emulation of a Paul trap, it is important to trap charged particles in the center of the trap.

Figure 23:
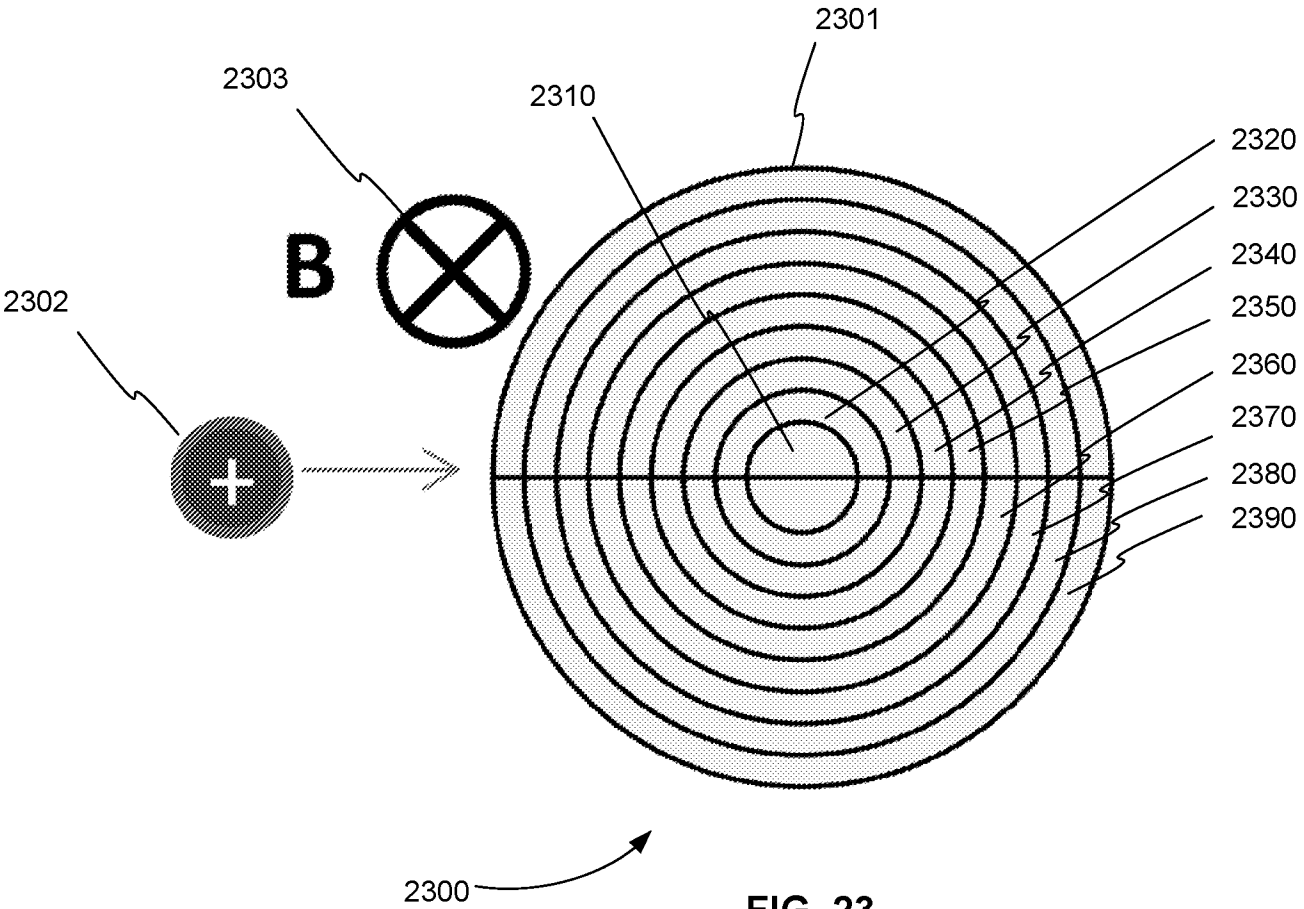
FIG. 23 is a top view of a set of PCB electrodes used in a side-on injection Penning trap that includes a segmented central disk electrode to bring charged particles to the center of the trap, in accordance with various embodiments.

FIG. 23 is a top view 2300 of a set of PCB electrodes used in a side-on injection Penning trap that includes a segmented central disk electrode to bring charged particles to the center of the trap, in accordance with various embodiments. Set of PCB electrodes 2301 includes nine concentric circular PCB electrodes. Specifically, set of PCB electrodes 2301 includes central disk electrode 2310 and ring electrodes 2320-2390. Central disk electrode 2310 is segmented so that a segment intersects the center of central disk electrode 2310. This provides a path for a charged particle 2302 to move to the center of central disk electrode 2310 and, therefore, the center of the trap. Ring electrodes 2150-2190 are also segmented so that their segments provide a path for charged particle 2102 to reach central disk electrode 2310 after being injected into the side-on injection Penning trap in a direction perpendicular to magnetic field 2303.

System for Bringing Charged Particles to the Trap Center

Figure 24:
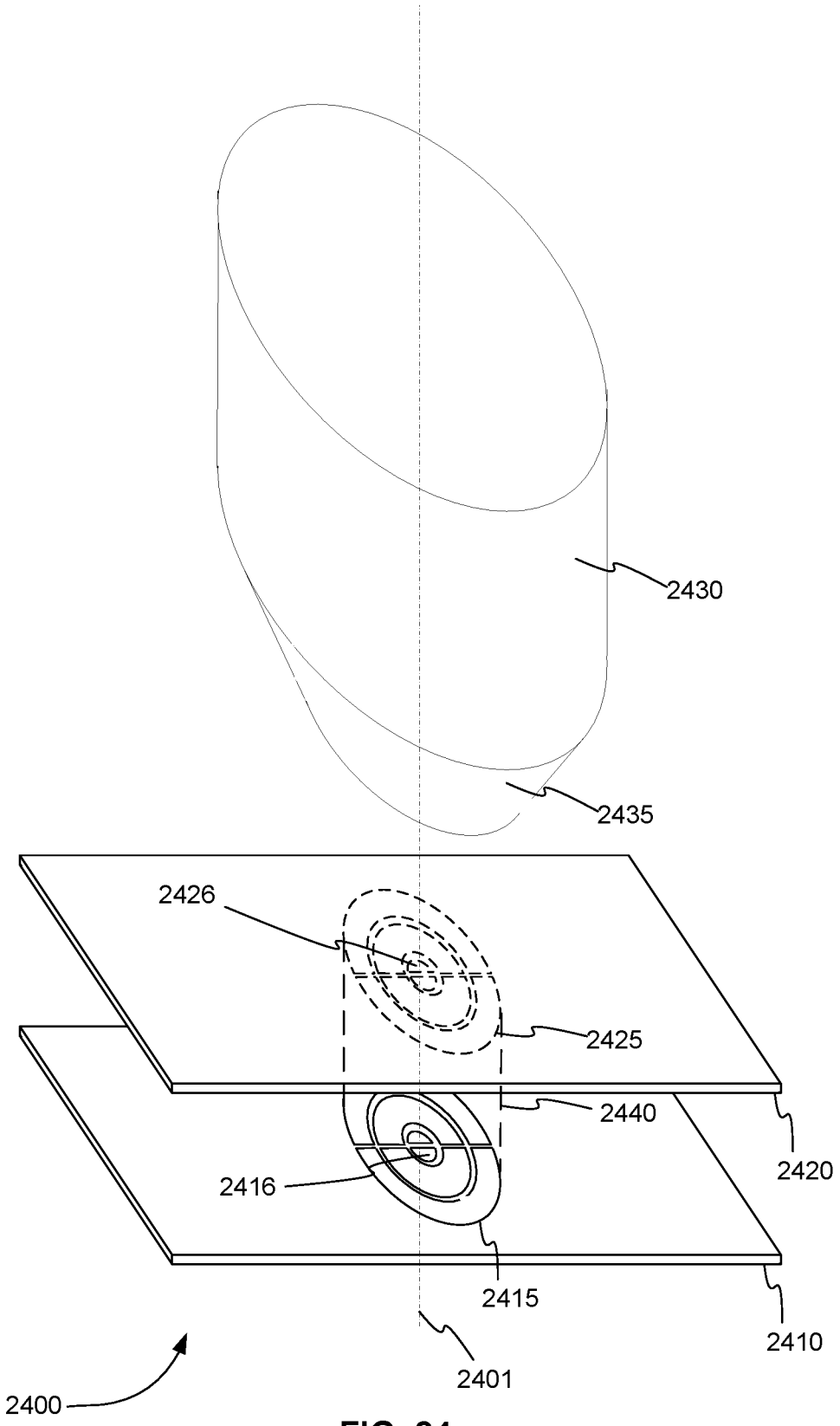
FIG. 24 is an exploded, oblique, and three-dimensional view of a side-on injection Penning trap that includes two sets of PCB electrodes that each includes a segmented central disk electrode to bring charged particles to the center of the trap, in accordance with various embodiments.

FIG. 24 is an exploded, oblique, and three-dimensional view 2400 of a side-on injection Penning trap that includes two sets of PCB electrodes that each includes a segmented central disk electrode to bring charged particles to the center of the trap, in accordance with various embodiments. The side-on injection Penning trap includes first PCB 2410. A first set of two or more concentric circular or semi-circular electrodes 2415 is printed on first printed circuit board 2410. The first set of electrodes 2415 includes a first central disk electrode 2416 that is segmented so that a segment intersects the center of first central disk electrode 2416.

The side-on injection Penning trap also includes second PCB 2420. A second set of two or more concentric circular or semi-circular electrodes 2425 is printed on second PCB 2420. The second set of electrodes 2425 includes a second central disk electrode 2426 that is segmented so that a segment intersects the center of second central disk electrode 2426. Second PCB 2420 is placed in parallel with first PCB 2410 so that second set of electrodes 2425 faces and is coaxial with first set of electrodes 2415. Second set of electrodes 2425 and first set of electrodes 2415 share axis 2401, for example.

The space between first set of electrodes 2415 and the second set of electrodes 2425 is a cylindrical gap 2440 used to trap charged particles. The segments of first central disk electrode 2416 and second central disk electrode 2426 provide a path for the charged particles to move to the center of cylindrical gap 2440. First set of electrodes 2415 and second set of electrodes 2425 apply a quadrupole electric field to cylindrical gap 2440. First set of electrodes 2415 and second set of electrodes 2425 are electrically connected to one or more voltage sources (not shown), for example.

The side-on injection Penning trap further includes at least one permanent magnet 2430. At least one permanent magnet 2430 is placed coaxially, along axis 2401, with first set of electrodes 2415 and second set of electrodes 2425, but outside of the cylindrical gap 2440. At least one permanent magnet 2430 applies a first magnetic field to the cylindrical gap 2440 that is coaxial with the cylindrical gap 2440. In a preferred embodiment, two permanent magnets (as shown in FIGS. 2 and 7) are used to apply the magnetic field to cylindrical gap 2440. At least one permanent magnet 2430 can include a tapered or cone end 2435 to amplify or focus the magnetic field. The effects of the first magnetic field and the quadrupole electric field combine to trap charged particles in the cylindrical gap 2440 that are injected in a direction perpendicular to the first magnetic field.

In various embodiments, the side-on injection Penning trap is used in quantum computing devices.

In various embodiments, the side-on injection Penning trap is used in atomic physics instruments.

In various embodiments, the side-on injection Penning trap can further include a system to stabilize the magnetic field applied in the cylindrical gap 2440 analogous to the system shown in FIG. 9. The system to stabilize the magnetic field shown in FIG. 9 includes at least one solenoid coil 950, current source 960, at least one magnetic sensor 970, and feedback control circuitry 980.

Segmented Outer Ring Electrodes to Increase Charged Particle Pathway

In another embodiment, the pathway of the charged particles in a side-on injection Penning trap is increased by segmenting one or more outer PCB ring electrodes into ring segments separated by at least two non-conducting spaces that are more than 180 degrees apart in one direction. In a side-on injection Penning trap, charged particles move through the trap following non-conducting spaces of the PCB electrodes. First, the charged particles are injected into the trap following a first series of one or more non-conducting spaces between segments of outer PCB ring electrodes. Then, they are guided in a semi-circular path around the central axis of the trap following non-conducting spaces between an outer PCB ring electrode and an inner PCB ring electrode or between an outer PCB ring electrode and a central disk electrode. Finally, they are ejected out of the trap following a second series of one or more non-conducting spaces between segments of the outer PCB ring electrodes. As a result, the position of non-conducting spaces between segments of the outer PCB ring electrodes determines the path length.

As shown in FIG. 3, the side-on injection Penning trap disclosed in the '459 Application included two outer ring electrodes that were segmented into two equal halves. Consequently, non-conducting spaces between segments of outer PCB ring electrodes were positioned 180 degrees apart. This means that the semi-circular pathway of the charged particles around the central axis could not exceed 180 degree. This also means that one entire half of the trap was not used for trapping charged particles.

As described above, the sensitivity of a mass spectrometer can be increased by increasing the total number of ions stored in a trap. As a result, increasing the pathway of the charged particles in a side-on injection Penning trap can increase the sensitivity of measurements made using the trap.

Figure 25:
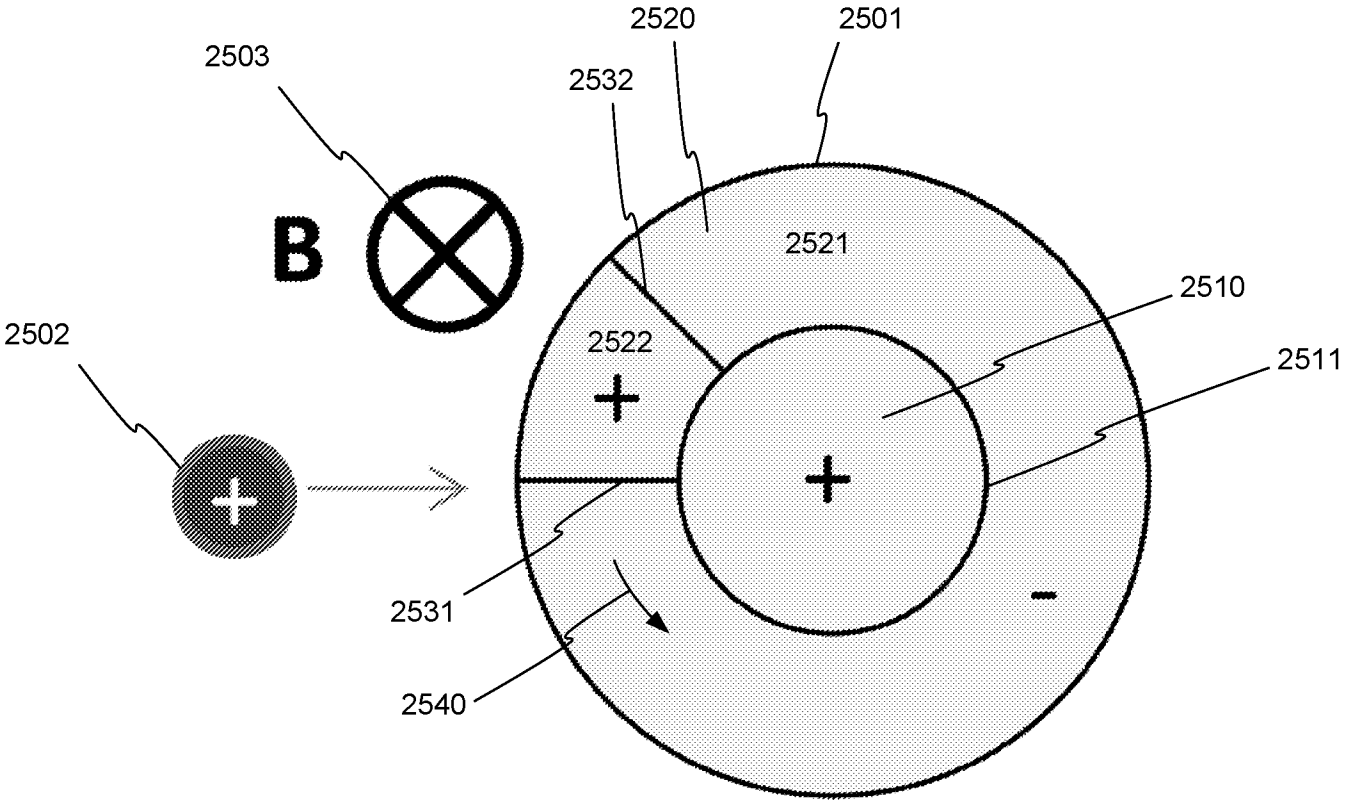
FIG. 25 is a top view of a set of PCB electrodes used in a side-on injection Penning trap that includes an outer ring electrode that is segmented and biased to increase the pathway of a charged particle around the trap to more than 180 degrees so that more ions can be placed in the trap thereby increasing the sensitivity of measurements made with the trap, in accordance with various embodiments.

FIG. 25 is a top view 2500 of a set of PCB electrodes used in a side-on injection Penning trap that includes an outer ring electrode that is segmented and biased to increase the pathway of a charged particle around the trap to more than 180 degrees so that more ions can be placed in the trap thereby increasing the sensitivity of measurements made with the trap, in accordance with various embodiments. Set of PCB electrodes 2501 includes central disk electrode 2510 and outer ring electrode 2520. Outer ring electrode 2520 is segmented into two ring segments 2521 and 2522 so that first non-conducting space 2531 and second non-conducting space 2532 between ring segments 2521 and 2522 are more than 180 degrees apart in direction 2540 around the central axis of the trap.

A charged particle 2502 is injected into the trap perpendicular to magnetic field 2503. Charged particle 2502 enters the trap following first non-conducting space 2531. Charged particle 2502 then follows semi-circular non-conducting space 2511 between central disk electrode 2510 and outer ring electrode 2520 to non-conducting space 2532.

Central disk electrode 2510 and ring segment 2522 are positively biased. Ring segment 2521 is negatively biased. As a result, positively charged particle 2502 follows non-conducting space 2511 in direction 2540. Consequently, the path followed along non-conducting space 2511 to non-conducting space 2532 is greater than 180 degrees, and more of the trap is utilized for charged particle trapping than in FIG. 3, for example. Charged particle 2502 exits the trap following non-conducting space 2532.

Figure 26:
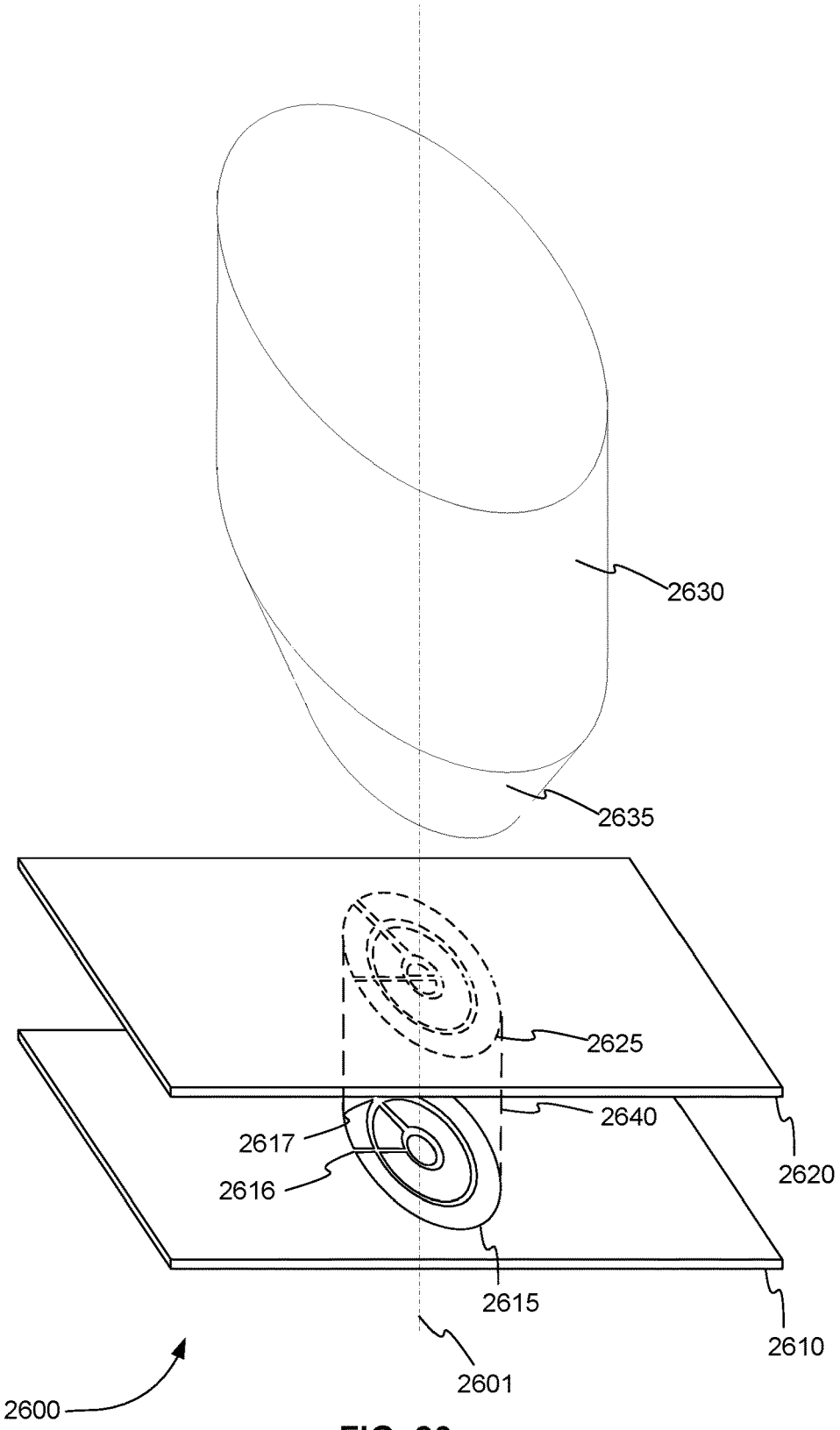
FIG. 26 is an exploded, oblique, and three-dimensional view of a side-on injection Penning trap that includes two sets of PCB electrodes that each includes one or more outer ring electrodes that are each segmented and biased to increase the pathway of charged particles around the trap to more than 180 degrees so that more ions can be placed in the trap thereby increasing the sensitivity of measurements made with the trap, in accordance with various embodiments.

System for Increasing the Path Length of Charged Particles to Increase Sensitivity FIG. 26 is an exploded, oblique, and three-dimensional view 2600 of a side-on injection Penning trap that includes two sets of PCB electrodes that each includes one or more outer ring electrodes that are each segmented and biased to increase the pathway of charged particles around the trap to more than 180 degrees so that more ions can be placed in the trap thereby increasing the sensitivity of measurements made with the trap, in accordance with various embodiments. The side-on injection Penning trap includes first PCB 2610. A first set of two or more concentric circular or semi-circular electrodes 2615 is printed on first printed circuit board 2610.

The side-on injection Penning trap also includes second PCB 2620. A second set of two or more concentric circular or semi-circular electrodes 2625 is printed on second PCB 2620. Second PCB 2620 is placed in parallel with first PCB 2610 so that second set of electrodes 2625 faces and is coaxial with first set of electrodes 2615. Second set of electrodes 2625 and first set of electrodes 2615 share axis 2601, for example.

The space between first set of electrodes 2615 and the second set of electrodes 2625 is a cylindrical gap 2640 used to trap charged particles. First set of electrodes 2615 and the second set of electrodes 2625 each includes one or more outer ring electrodes that are each segmented into two or more ring segments separated by non-conducting spaces so that a first non-conducting space 2616 that guides the charged particles into cylindrical gap 2640 and a second non-conducting space 2617 that guides the charged particles out of cylindrical gap 2640 are more than 180 degrees apart in a direction around an axis of cylindrical gap 2640, wherein the first set of electrodes and the second set of electrodes are biased so that the charged particles are directed more than 180 degrees around the axis from first non-conducting space 2616 to second non-conducting space 2617. First set of electrodes 2615 and second set of electrodes 2625 apply a quadrupole electric field to cylindrical gap 2640. First set of electrodes 2615 and second set of electrodes 2625 are electrically connected to one or more voltage sources (not shown), for example.

The side-on injection Penning trap further includes at least one permanent magnet 2630. At least one permanent magnet 2630 is placed coaxially, along axis 2601, with first set of electrodes 2615 and second set of electrodes 2625, but outside of the cylindrical gap 2640. At least one permanent magnet 2630 applies a first magnetic field to the cylindrical gap 2640 that is coaxial with the cylindrical gap 2640. In a preferred embodiment, two permanent magnets (as shown in FIGS. 2 and 7) are used to apply the magnetic field to cylindrical gap 2640. At least one permanent magnet 2630 can include a tapered or cone end 2635 to amplify or focus the magnetic field. The effects of the first magnetic field and the quadrupole electric field combine to trap charged particles in the cylindrical gap 2640 that are injected in a direction perpendicular to the first magnetic field.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A side-on injection Penning trap that includes feedback control for stabilizing the magnetic field applied to charged particles, comprising:

a first printed circuit board on which is printed a first set of two or more concentric circular or semi-circular electrodes;

a second printed circuit board on which is printed a second set of two or more concentric circular or semi-circular electrodes that correspond in size and shape to the first set of electrodes, wherein the second printed circuit board is placed in parallel with the first printed circuit board so that the second set of electrodes faces and is coaxial with the first set of electrodes, wherein the space between the first set of electrodes and the second set of electrodes is a cylindrical gap used to trap charged particles, and wherein the first set of electrodes and the second set of electrodes apply a quadrupole electric field to the cylindrical gap;

at least one permanent magnet that is placed coaxially with the first set of electrodes and the second set of electrodes but outside of the cylindrical gap that applies a first magnetic field to the cylindrical gap that is coaxial with the cylindrical gap, wherein the effects of the first magnetic field and the quadrupole electric field combine to trap charged particles in the cylindrical gap that are injected in a direction perpendicular to the first magnetic field;

at least one solenoid coil that is placed coaxially with the cylindrical gap, but outside of the cylindrical gap;

a current source electrically connected to the at least one solenoid coil that supplies current to the at least one solenoid coil to produce a second magnetic field that is applied to the cylindrical gap that is coaxial with the cylindrical gap;

at least one magnetic sensor placed in or on the first printed circuit board within the first set of electrodes that measures a combined magnetic field that is a combination of the first magnetic field and the second magnetic field; and feedback control circuitry electrically connected to the at least one magnetic sensor and the current source that that receives over time the combined magnetic field measured by the at least one magnetic sensor and in response adjusts the current of the current source to increase or decrease the second magnetic field in order to maintain the combined magnetic field at a constant value.

2. The side-on injection Penning trap of claim 1, wherein the at least one magnetic sensor comprises a Hall effect sensor.

3. The side-on injection Penning trap of claim 1, wherein feedback control circuitry comprises an analog circuit.

4. The side-on injection Penning trap of claim 1, wherein feedback control circuitry comprises a digital circuit.

5. The side-on injection Penning trap of claim 1, wherein feedback control circuitry comprises a microcontroller.

6. The side-on injection Penning trap of claim 1, wherein feedback control circuitry comprises a processor also used to control the quadrupole electric field.

7. The side-on injection Penning trap of claim 1, wherein the first set of electrodes and the second set of electrodes each includes a central disk electrode and one or more concentric segmented ring or arch electrodes.

8. The side-on injection Penning trap of claim 1, wherein the charged particles comprise ions and wherein the side-on injection Penning trap is used in Fourier transform ion cyclotron resonance (FT-ICR) mass spectrometry.

9. A method for stabilizing the magnetic field applied to charged particles in a side-on injection Penning trap, comprising:

applying a quadrupole electric field to a cylindrical gap between a first set of two or more concentric circular or semi-circular electrodes and a second set of two or more concentric circular or semi-circular electrodes using the first set of electrodes and the second set of electrodes, wherein the first set of electrodes is printed on a first printed circuit board and the second set of electrodes is printed on a second printed circuit board, wherein the second printed circuit board is placed in parallel with the first printed circuit board so that the second set of electrodes faces and is coaxial with the first set of electrodes, and wherein the space between the first set of electrodes and the second set of electrodes is the cylindrical gap used to trap charged particles;

applying a first magnetic field to the cylindrical gap that is coaxial with the cylindrical gap using at least one permanent magnet, wherein the at least one permanent magnet that is placed coaxially with the first set of electrodes and the second set of electrodes but outside of the cylindrical gap and wherein the effects of the first magnetic field and the quadrupole electric field combine to trap charged particles in the cylindrical gap that are injected in a direction perpendicular to the first magnetic field;

applying a second magnetic field to the cylindrical gap that is coaxial with the cylindrical gap using at least one solenoid coil electrically connected to a current source, wherein the current source supplies current to the at least one solenoid coil to produce the second magnetic field and wherein the at least one solenoid coil is placed coaxially with the cylindrical gap, but outside of the cylindrical gap;

measuring a combined magnetic field that is a combination of the first magnetic field and the second magnetic field using at least one magnetic sensor placed in or on the first printed circuit board within the first set of electrodes; and stabilizing the combined magnetic field using feedback control circuitry electrically connected to the at least one magnetic sensor and the current source by repeatedly over time receiving the measurement of the at least one magnetic sensor and in response adjusting the current of the current source to increase or decrease the second magnetic field in order to maintain the combined magnetic field at a constant value.

10. A side-on injection Penning trap that includes two sets of printed circuit board electrodes with radial dimensions that are optimized to apply a quadrupole field to charged particles, comprising:

a first printed circuit board on which is printed a first set of two or more concentric circular or semi-circular electrodes;

a second printed circuit board on which is printed a second set of two or more concentric circular or semi-circular electrodes that correspond in size and shape to the first set of electrodes, wherein the second printed circuit board is placed in parallel with the first printed circuit board so that the second set of electrodes faces and is coaxial with the first set of electrodes, wherein the space between the first set of electrodes and the second set of electrodes is a cylindrical gap used to trap charged particles, wherein the cylindrical gap has a length d, wherein the first set of electrodes and the second set of electrodes each includes a central disk electrode with a radius of 1.1 d, a first concentric ring or segmented ring electrode of radius 1.9 d, and a second concentric ring or segmented ring electrode of radius 2.4 d, and wherein the first set of electrodes and the second set of electrodes apply a quadrupole electric field to the cylindrical gap; and at least one permanent magnet that is placed coaxially with the first set of electrodes and the second set of electrodes but outside of the cylindrical gap that applies a first magnetic field to the cylindrical gap that is coaxial with the cylindrical gap, wherein the effects of the first magnetic field and the quadrupole electric field combine to trap charged particles in the cylindrical gap that are injected in a direction perpendicular to the first magnetic field;

at least one solenoid coil that is placed coaxially with the cylindrical gap, but outside of the cylindrical gap;

a current source electrically connected to the at least one solenoid coil that supplies current to the at least one solenoid coil to produce a second magnetic field that is applied to the cylindrical gap that is coaxial with the cylindrical gap;

at least one magnetic sensor placed in or on the first printed circuit board within the first set of electrodes that measures a combined magnetic field that is a combination of the first magnetic field and the second magnetic field; and feedback control circuitry electrically connected to the at least one magnetic sensor and the current source that that receives over time the combined magnetic field measured by the at least one magnetic sensor and in response adjusts the current of the current source to increase or decrease the second magnetic field in order to maintain the combined magnetic field at a constant value.

11. The side-on injection Penning trap of claim 10, wherein the charged particles comprise ions and wherein the side-on injection Penning trap is used in Fourier transform ion cyclotron resonance (FT-ICR) mass spectrometry.

* * * * *